US012708820B2

(12) United States Patent
Matthews et al.

(10) Patent No.: US 12,708,820 B2
(45) Date of Patent: Aug. 18, 2026

(54) CLUB HEAD HAVING BALANCED IMPACT AND SWING PERFORMANCE CHARACTERISTICS

(71) Applicant: KARSTEN MANUFACTURING CORPORATION, Phoenix, AZ (US)

(72) Inventors: Joshua B. Matthews, Phoenix, AZ (US); Ryan M. Stokke, Anthem, AZ (US); Erik M. Henrikson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/458,178

(22) Filed: Aug. 26, 2021

(65) Prior Publication Data

US 2022/0118322 A1 Apr. 21, 2022

Related U.S. Application Data

(60) Provisional application No. 63/070,565, filed on Aug. 26, 2020.

(51) Int. Cl.
*A63B 53/04* (2015.01)
*A63B 53/08* (2015.01)

(52) U.S. Cl.
CPC ..... *A63B 53/0466* (2013.01); *A63B 53/0412* (2020.08); *A63B 53/0433* (2020.08); *A63B 53/0437* (2020.08); *A63B 2053/0491* (2013.01); *A63B 53/08* (2013.01)

(58) Field of Classification Search
CPC ..... A63B 53/0466; A63B 53/0412; A63B 53/0437; A63B 53/0433; A63B 53/08; A63B 2053/0491
See application file for complete search history.

(56) References Cited

U.S. PATENT DOCUMENTS

| | | | | |
|---|---|---|---|---|
| 2,083,189 | A * | 6/1937 | Crooker | A63B 53/04 473/327 |
| 5,326,105 | A | 7/1994 | Fenton, Jr. | |
| 5,616,086 | A * | 4/1997 | Chappell | A63B 53/047 473/290 |
| 7,785,214 | B2 * | 8/2010 | Horacek | A63B 53/0466 473/345 |
| 8,241,142 | B2 * | 8/2012 | Evans | A63B 53/0466 473/345 |
| 8,845,453 | B1 * | 9/2014 | Ehlers | A63B 60/00 473/343 |
| 8,848,453 | B2 * | 9/2014 | Shen | G11C 16/3418 365/185.26 |
| 9,358,430 | B2 * | 6/2016 | Greaney | A63B 60/00 |
| 9,839,818 | B2 * | 12/2017 | Jertson | A63B 53/0466 |
| 10,035,048 | B2 * | 7/2018 | Stokke | A63B 53/0466 |
| 10,434,381 | B2 * | 10/2019 | Stokke | A63B 53/04 |

(Continued)

OTHER PUBLICATIONS

Mygolfspy, How This Tiny Thing Can Make A Huge Difference In You Next Driver, CG Defined, by Tony Covey, https://mygolfspy.com/labs/golf-club-center-of-gravity-cg/, May 2015.*

*Primary Examiner* — William M Pierce

(57) ABSTRACT

Embodiments of golf club heads having balanced impact and swing performance characteristics with reversed crown and sole curvatures are generally described herein. Other embodiments may be described and claimed.

7 Claims, 10 Drawing Sheets

(56) References Cited

U.S. PATENT DOCUMENTS 10,799,773 B2 * 10/2020 Burnett ..... A63B 53/0466
10,828,541 B2 * 11/2020 Stokke ..... A63B 53/04
10,864,413 B2 * 12/2020 Stokke ..... A63B 53/0466
10,967,232 B2 * 4/2021 Woodward ..... A63B 60/02
11,117,026 B2 * 9/2021 Stokke ..... A63B 53/02
11,358,037 B2 * 6/2022 Stokke ..... A63B 53/0466
12,458,850 B2 * 11/2025 Mizutani ..... A63B 53/0437
2003/0148822 A1 * 8/2003 Knuth ..... A63B 53/0466 473/345
2007/0155539 A1 * 7/2007 Schweigert ..... A63B 53/0466 473/345
2009/0075752 A1 * 3/2009 Hirano ..... A63B 53/0466 473/345
2010/0016097 A1 * 1/2010 Albertsen ..... A63B 53/0466 473/345
2010/0292020 A1 * 11/2010 Tavares ..... A63B 53/04 473/282
2011/0183776 A1 * 7/2011 Breier ..... A63B 53/0466 473/345
2011/0192001 A1 * 8/2011 Evans ..... A63B 53/0466 29/407.01
2011/0192002 A1 * 8/2011 Evans ..... A63B 53/0466 29/407.1
2011/0195800 A1 * 8/2011 Evans ..... A63B 53/0466 473/345
2011/0195801 A1 * 8/2011 Evans ..... A63B 53/0466 473/345
2011/0247190 A1 * 10/2011 Evans ..... A63B 53/0466 29/407.01
2012/0015757 A1 * 1/2012 Evans ..... A63B 53/0466 473/345
2012/0071268 A1 * 3/2012 Albertsen ..... A63B 53/0466 473/327
2012/0322578 A1 * 12/2012 Ban ..... A63B 60/00 473/345
2013/0109494 A1 * 5/2013 Henrikson ..... A63B 60/52 473/328
2013/0123040 A1 * 5/2013 Willett ..... F15D 1/10 473/327
2014/0087893 A1 * 3/2014 Henrikson ..... A63B 60/52 29/428
2014/0213389 A1 * 7/2014 Yamamoto ..... B22D 21/005 164/113
2015/0072803 A1 * 3/2015 Golden ..... A63B 60/02 473/345
2015/0126296 A1 5/2015 Fossum
2015/0306471 A1 * 10/2015 Albertsen ..... A63B 53/0466 473/327
2016/0001146 A1 1/2016 Sargent
2016/0184666 A1 * 6/2016 Mizutani ..... A63B 53/0466 473/342
2016/0213985 A1 * 7/2016 Jertson ..... A63B 53/0466
2016/0271462 A1 * 9/2016 Knuth ..... A63B 60/00
2017/0043222 A1 * 2/2017 Stokke ..... A63B 53/0466
2017/0182379 A1 * 6/2017 Mizutani ..... A63B 53/0466
2017/0182380 A1 * 6/2017 Mizutani ..... A63B 53/0466
2017/0319917 A1 * 11/2017 Henrikson ..... A63B 53/0466
2017/0333762 A1 * 11/2017 Jertson ..... A63B 53/0466
2018/0078832 A1 * 3/2018 Stokke ..... A63B 53/04
2018/0117431 A1 * 5/2018 Kultala ..... A63B 53/10
2018/0140906 A1 * 5/2018 Stokke ..... A63B 53/0466
2018/0353818 A1 * 12/2018 Henrikson ..... A63B 53/0466
2019/0015714 A1 * 1/2019 Kato ..... A63B 53/0466
2019/0192925 A1 * 6/2019 Rife ..... A63B 53/0408
2019/0275386 A1 * 9/2019 Henrikson ..... A63B 60/52
2019/0282867 A1 9/2019 Chao
2019/0336834 A1 * 11/2019 Greaney ..... A63B 53/0412
2019/0374824 A1 * 12/2019 Albertsen ..... A63B 53/0466
2020/0360772 A1 * 11/2020 Woodward ..... A63B 53/0462
2021/0322838 A1 * 10/2021 Willett ..... A63B 60/00
2022/0118322 A1 * 4/2022 Matthews ..... A63B 53/0433
2023/0173349 A1 * 6/2023 Ogg ..... A63B 60/006 473/345
2023/0338793 A1 * 10/2023 Milleman ..... A63B 53/0475

* cited by examiner

CLUB HEAD HAVING BALANCED IMPACT AND SWING PERFORMANCE CHARACTERISTICS

CROSS REFERENCE TO RELATED APPLICATION

This application claims the benefit of U.S. Provisional Patent Application No. 63/070,565, filed on Aug. 26, 2020, the contents of which is incorporated fully herein by reference.

FIELD

The present disclosure relates to golf club heads. In particular, the present disclosure is related to golf club heads having balanced impact and swing performance characteristics with reversed crown and sole curvatures.

BACKGROUND

Various golf club head design parameters, such as volume, center of gravity position and moment of inertia, affect impact performance characteristics (e.g. spin, launch angle, speed, forgiveness) and swing performance characteristics (e.g. aerodynamic drag, ability to square the club head at impact). Often, club head designs that focus upon improving impact performance characteristics can adversely affect swing performance characteristics (e.g. aerodynamic drag), or club head designs that improve swing performance characteristics can adversely affect impact performance characteristics. Accordingly, there is a need in the art for a club head having enhanced impact performance characteristics balanced with enhanced swing characteristics.

Figure 1A:
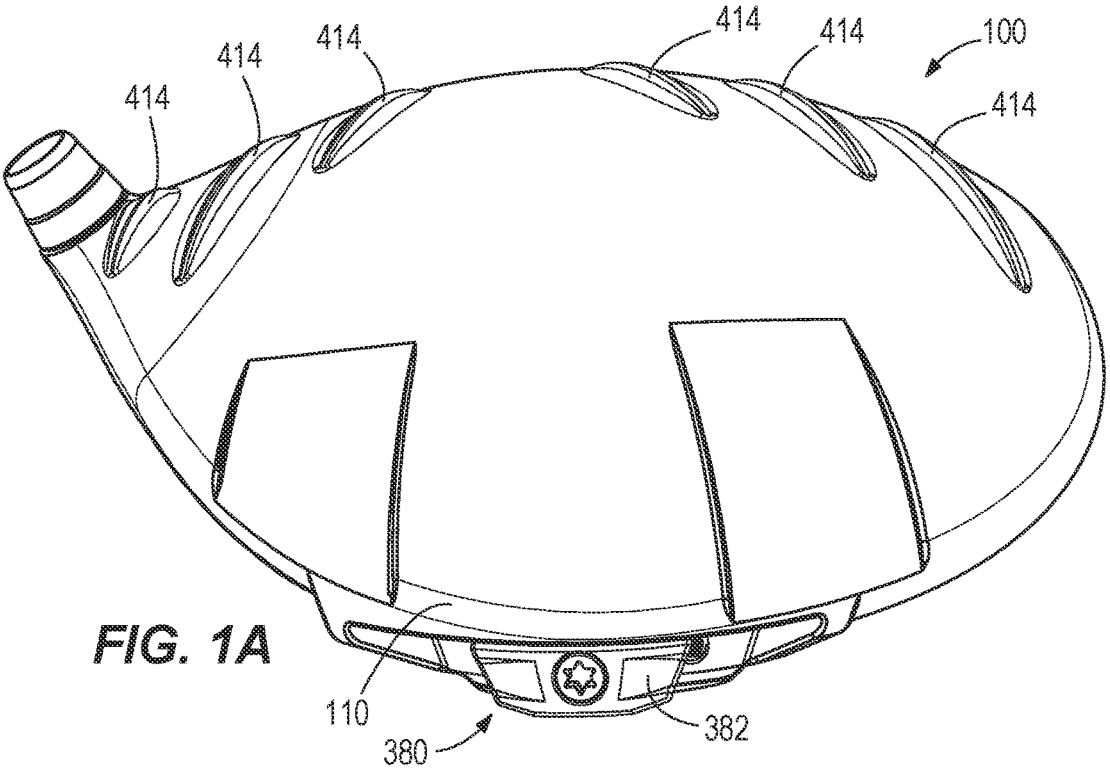
FIG. 1A is a bottom view of a golf club head according to one embodiment.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club head that comprises a sole contour that resembles a typical crown contour, and a crown contour that resembles a typical sole contour. In other words, the golf club head of the invention described herein comprises a flattened sole and a more curved crown. This structure can result in a lower center of gravity (CG) and reduced aerodynamic drag by delaying separation of air flow upon the crown. The structure of the golf club head described herein further increases discretionary weight and/or repositions discretionary weight to increase its distance from the club head CG, resulting in a CG positioned low and rearward, and an increased moment of inertia (MOI).

The golf club described below uses several relationships to maintain or increase the club head moment of inertia (MOI) with a down and back CG position while simultaneously reducing aerodynamic drag. Balancing relationships between CG, MOI, and drag leads to improved impact performance characteristics (e.g. spin, launch angle, ball speed, and forgiveness) and swing performance characteristics (e.g. aerodynamic drag, ability to square the club head at impact, swing speed). The desired balance can be modulated by adjusting mass distribution, curvature, and surface shape.

The shape of the golf club head described herein leads to improved aerodynamic properties when compared with golf club head 100' having a similar CG position and MOI. Aerodynamic drag is reduced by maximizing the crown height while maintaining a low CG position. This combination results in increased airflow acceleration in the front portion of the crown, thereby delaying airflow separation toward the rear. Transition profiles between the strikeface to crown, strikeface to sole, and/or crown to sole along the back end of the golf club head provide a means to further reduce aerodynamic drag. The use of turbulators and reduction of hosel size further reduce aerodynamic drag, especially at the impact position. Further, the golf club head comprises an curvature profile with a smaller heel-to-toe crown radius of curvature and a greater heel-to-toe sole radius of curvature.

The golf club described herein has a down and back CG and high MOI as specified. The golf club further has a high crown-to-sole moment of inertia (Ixx) and heel-to-toe moment of inertia (Iyy). A down and back CG and increased MOI are achieved by increasing discretionary weight or repositioning discretionary weight regions of the golf club head be positioned at maximum distances from the head CG. Thinning the crown and/or using optimized materials increases discretionary weighting. Using removable weights, and an improved face strike face shape, allow for discretionary weight to be removed and placed at a maximum distance from the CG.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

A "driver-type golf club head," also referred to as a driver, as described herein, can be defined by specific dimensional ranges. In particular, the driver, as described with regard to the invention disclosed herein, includes a loft angle, volume, length, depth, and height within the ranges defined below.

The driver "club head depth" is as described herein and can be measured as described below. The depth of the driver is greater than 4.5 inches, greater than 4.6 inches, greater than 4.7 inches, greater than 4.8, greater than 4.9 inches, or greater than 5.0 inches. The club head length is measured as described below. The length of the driver is greater than 4.5 inches, greater than 4.6 inches, greater than 4.7 inches, greater than 4.8, greater than 4.9 inches, or greater than 5.0 inches.

The "loft angle" of the driver is as described herein can be defined by a driver club head having a loft angle that is less than approximately 16 degrees, less than approximately 15 degrees, less than approximately 14 degrees, less than approximately 13 degrees, less than approximately 12 degrees, less than approximately 11 degrees, or less than approximately 10 degrees.

The volume of the driver is as described herein and can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc.

The club head height is as described herein and is measured as described below. The height of the driver is greater than 2.0 inches and less than 3.0 inches, less than 2.9 inches, less than 2.8 inches, less than 2.7, or less than 2.6 inches. The face height of the driver is between 1.3 inches (33 mm) and 3.8 inches (71 mm). The driver comprises a mass between 185 grams and 225 grams.

The term "geometric center" as described herein can be identified as defined below. The geometric center can be the centerpoint of a strikeface perimeter, and at a midpoint of a face height. Alternately, the geometric center can be centered with respect to an "engineered impact zone", which can be defined by a region of grooves on the strikeface. As another approach, the geometric center of the strikeface can be located in accordance with the definition of a golf governing body such as the United States Golf Association (USGA). For example, the geometric center of the strikeface can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The term "loft plane" as described herein can be identified as defined below. The loft plane 1010 is tangent to the geometric center 140 of the strikeface 104. The face height can be measured parallel to the loft plane 1010 between a top end of the strikeface perimeter near the crown and a bottom end of the strikeface perimeter near the sole. In these embodiments, the strikeface perimeter can be located along the outer edge of the strikeface 104 where the curvature deviates from the bulge and/or roll of the strikeface 104.

A X'Y'Z' coordinate system, as described herein, is based upon the geometric center of the strikeface. The driver dimensions as described herein can be measured based on a coordinate system as defined below. The geometric center of the strikeface defines a coordinate system having an origin located at the geometric center of the strikeface, the coordinate system having an X' axis, a Y' axis, and a Z' axis. The X' axis extends through the geometric center of the strikeface in a direction from the heel to the toe of the club head. The Y' axis extends through the geometric center of the strikeface in a direction from the crown to the sole of the club head and perpendicular to the X' axis, and the Z' axis extends through the geometric center of the strikeface in a direction from the front end to the back end of the club head and perpendicular to the X' axis and the Y' axis.

The X'Y'Z'coordinate system as described herein defines an X'Y' plane extending through the X' axis and the Y' axis, an X'Z' plane extending through the X' axis and the Z' axis, and a Y'Z' plane extending through the Y' axis and the Z' axis, wherein the X'Y' plane, the X'Z' plane, and the Y'Z' plane are all perpendicular to one another and intersect at the origin of the coordinate system located at the geometric center of the strikeface 104. The X'Y' plane extends parallel to a hosel axis, wherein the hosel axis extends centrally along a hosel structure bore and is positioned at an angle corresponding to the loft angle of the club head from the loft plane 1010. Further the X' axis is positioned at a 60 degree angle to the hosel axis when viewed from a direction perpendicular to the X'Y' plane. The club head is viewable from a front perspective when the strikeface 104 is viewed from a direction perpendicular to the X'Y' plane. The driver is viewable from a side perspective or side cross-sectional perspective when the club head is viewed from a direction perpendicular to the Y'Z' plane.

The term "depth," as described herein, can refer to a front-to-back dimension of the club head, as defined below. The depth of the club head is measured as the furthest extent of the club head from the front end to the back end, in a direction parallel to the Z' axis.

The club head length is as described herein, wherein the length of the club head is measured as the furthest extent of the club head from the heel to the toe, in a direction parallel to the X' axis, when viewed from the front view as defined previously. The length of the club head can be measured according to a golf governing body such as the United States Golf Association (USGA). For example, the length of the club head can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

The club head height is as described herein, wherein the height of the club head can be measured as the furthest extent of the club head from the crown to the sole, in a direction parallel to the Y' axis, when viewed from the front view as defined previously. In many embodiments, the height of the club head can be measured according to a golf governing body such as the United States Golf Association (USGA). For example, the height of the club head can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

The term "head depth plane", as described herein, refers to a plane extending through the geometric center 140 of the strikeface 104, perpendicular to the loft plane 1010, in a direction from the heel to the toe of the club head.

The head CG depth, as described herein, is measured as the offset distance between the center of gravity (CG) and the X'Y' plane in a direction perpendicular to the X'Y' plane. Alternately, the head CG depth can be measured as the offset distance between the CG and the loft plane 1010, measured in a direction perpendicular to the loft plane 1010.

The head CG height, as described herein, is measured as the offset distance between the center of gravity (CG) and the head depth plane in a direction perpendicular to the head depth plane toward the crown or toward the sole. The head CG height is denoted as positive when the head CG is located above the head depth plane (i.e. between the head depth plane and the crown), and the head CG height is denoted as negative with the head CG is located below the head depth plane (i.e. between the head depth plane and the sole). The absolute value of the head CG height can describe a head CG positioned above or below the head depth plane (i.e. between the head depth plane and the crown or between the head depth plane and the sole).

A xyz coordinate system, as described herein, is based upon the center of gravity of the club head. The head CG defines an origin of the coordinate system having an x-axis, a y-axis, and a z-axis. The y-axis extends through the head CG from the crown to the sole, parallel to the hosel axis when viewed from the side view and at a 30 degree angle from the hosel axis when viewed from the front view. The x-axis extends through the head CG from the heel to the toe and perpendicular to the y-axis when viewed from a front view and parallel to the X'Y' plane. The z-axis extends through the head CG from the front end to the back end and perpendicular to the x-axis and the y-axis. The x-axis extends through the head CG from the heel to the toe and parallel to the X' axis, the y-axis through the head CG from the crown to the sole parallel to the Y' axis, and the z-axis extends through the head CG from the front end to the back end and parallel to the Z' axis.

The term "$I_{xx}$", as described herein, refers to a crown-to-sole moment of inertia. The $I_{xx}$ is measured about the x-axis. The term "$I_{yy}$", as described herein, refers to a heel-to-toe moment of inertia. The $I_{yy}$ is measured about the y-axis. A combined moment of inertia, as described herein, is defined as a sum of the crown-to-sole moment of inertia and the heel-to-toe moment of inertia.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 5:
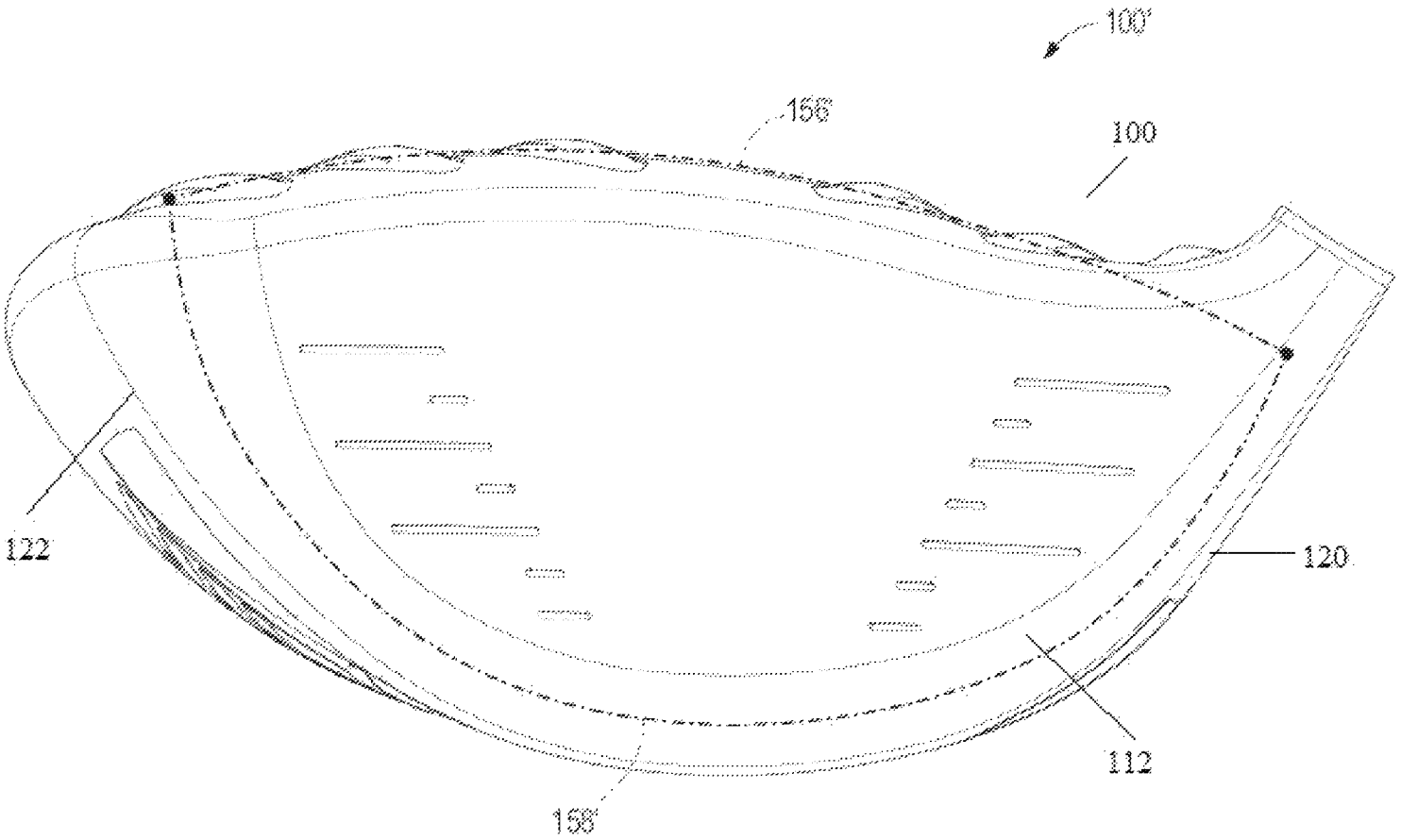
FIG. 5 is a front view of a golf club head without an curvature profile.
Figure 6:
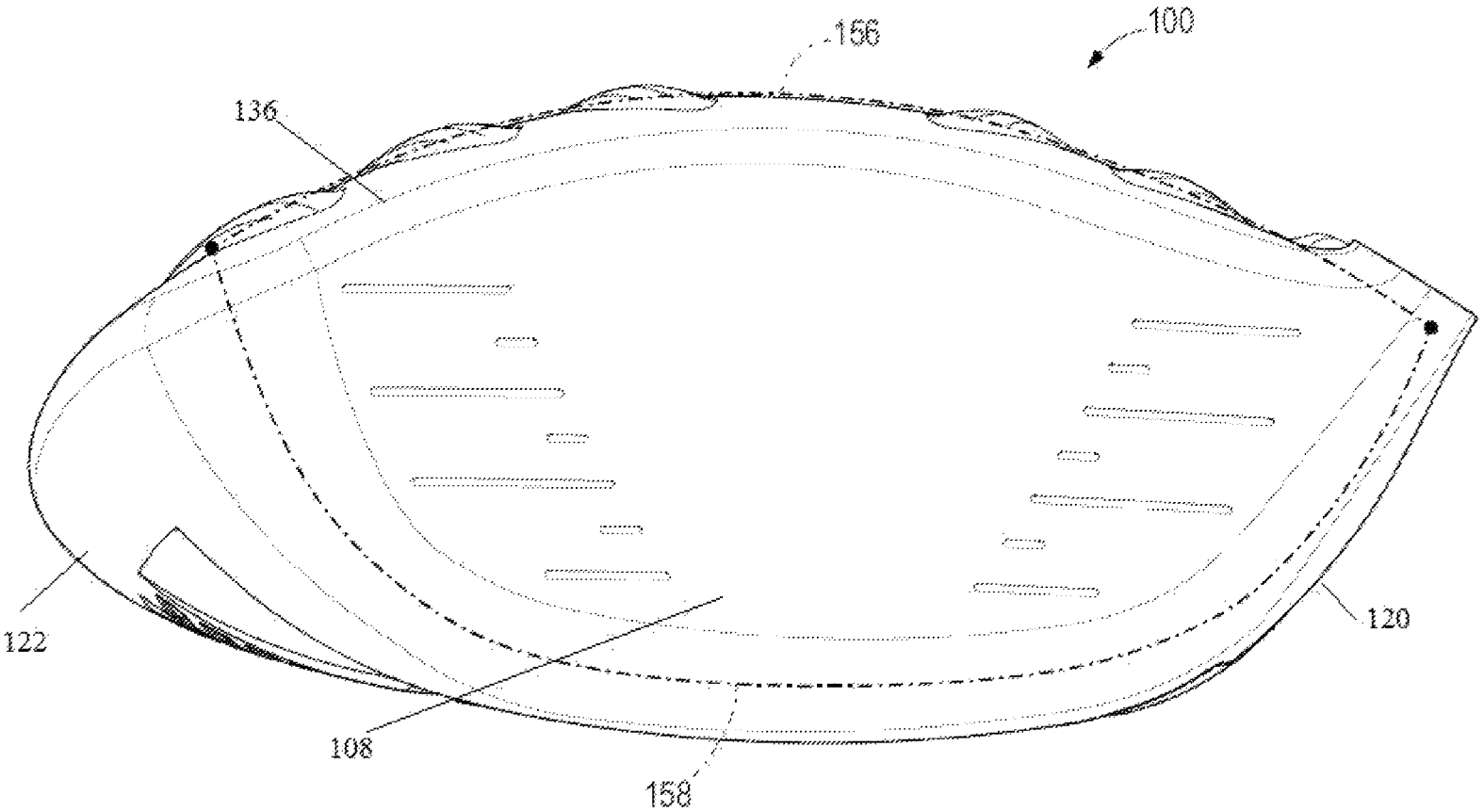
FIG. 6 is a front view of the golf club head of FIG. 1 with an curvature profile.
Figure 7B:
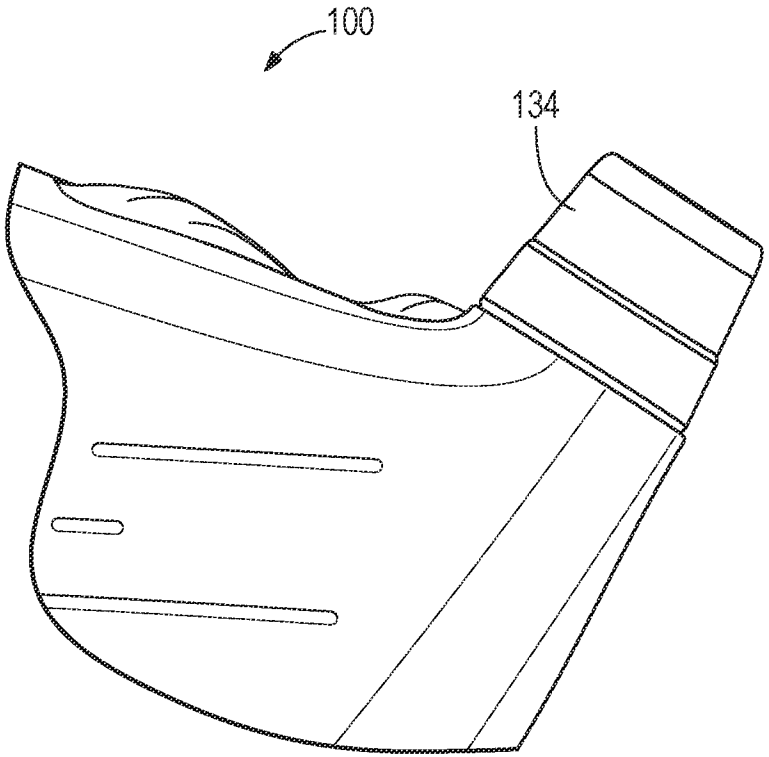
FIG. 7B is a hosel view of the golf club head of FIG. 1 with an curvature profile.
Figure 7A:
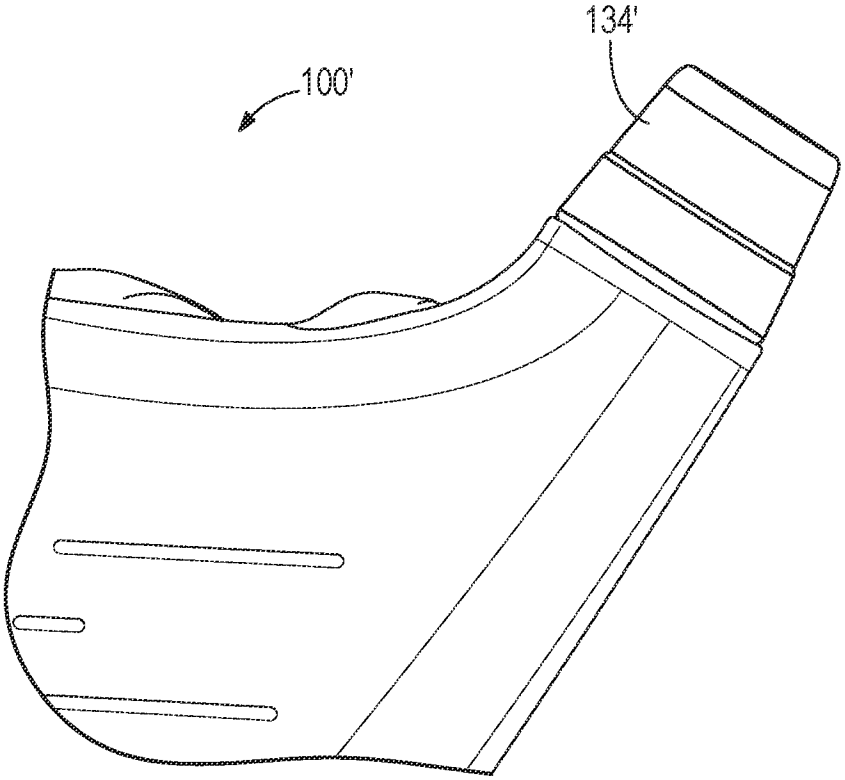
FIG. 7A is a hosel view of a golf club head without an curvature profile.
Figure 8:
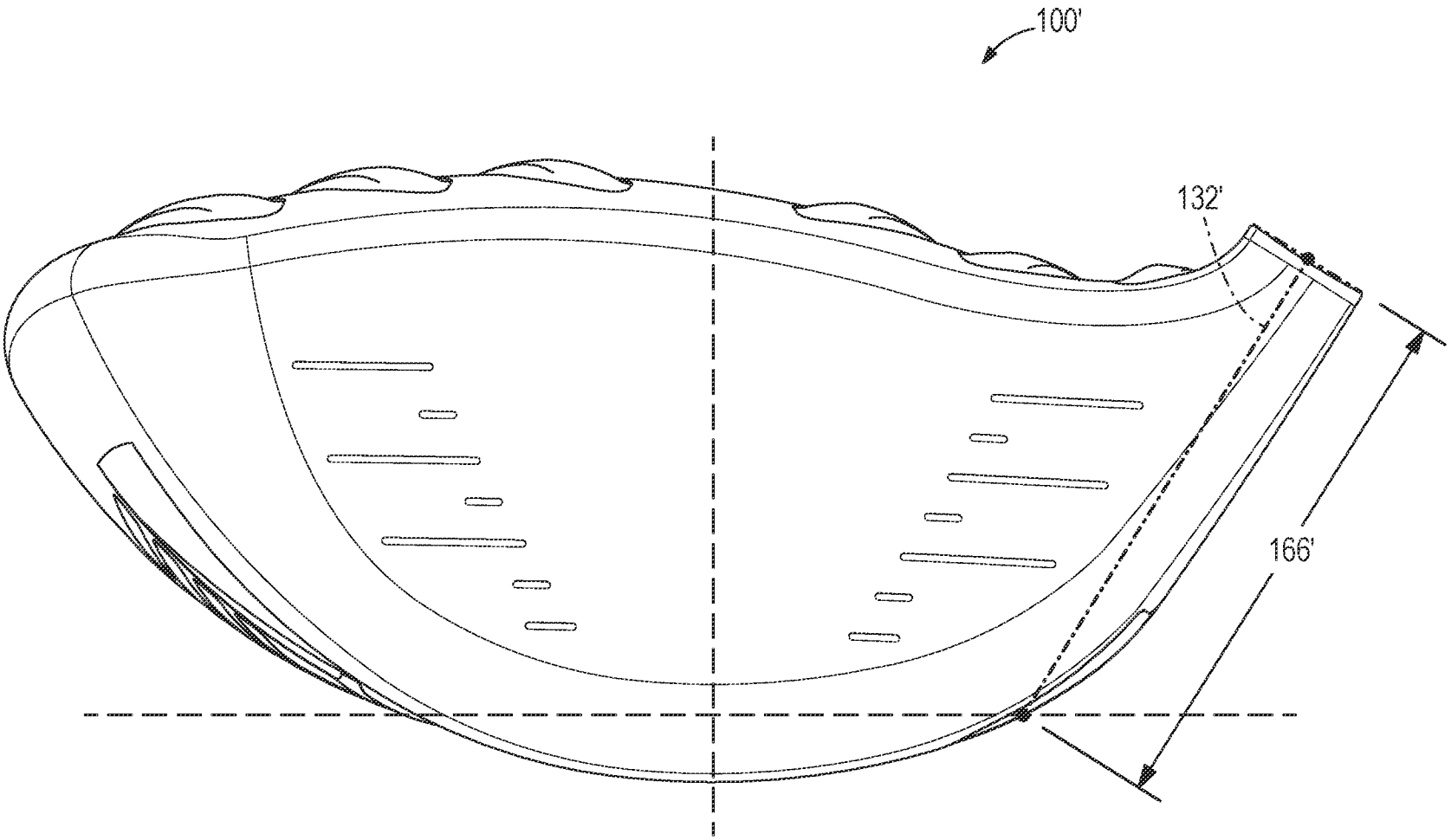
FIG. 8 is a dimensional hosel view of a golf club head without an curvature profile.
Figure 9:
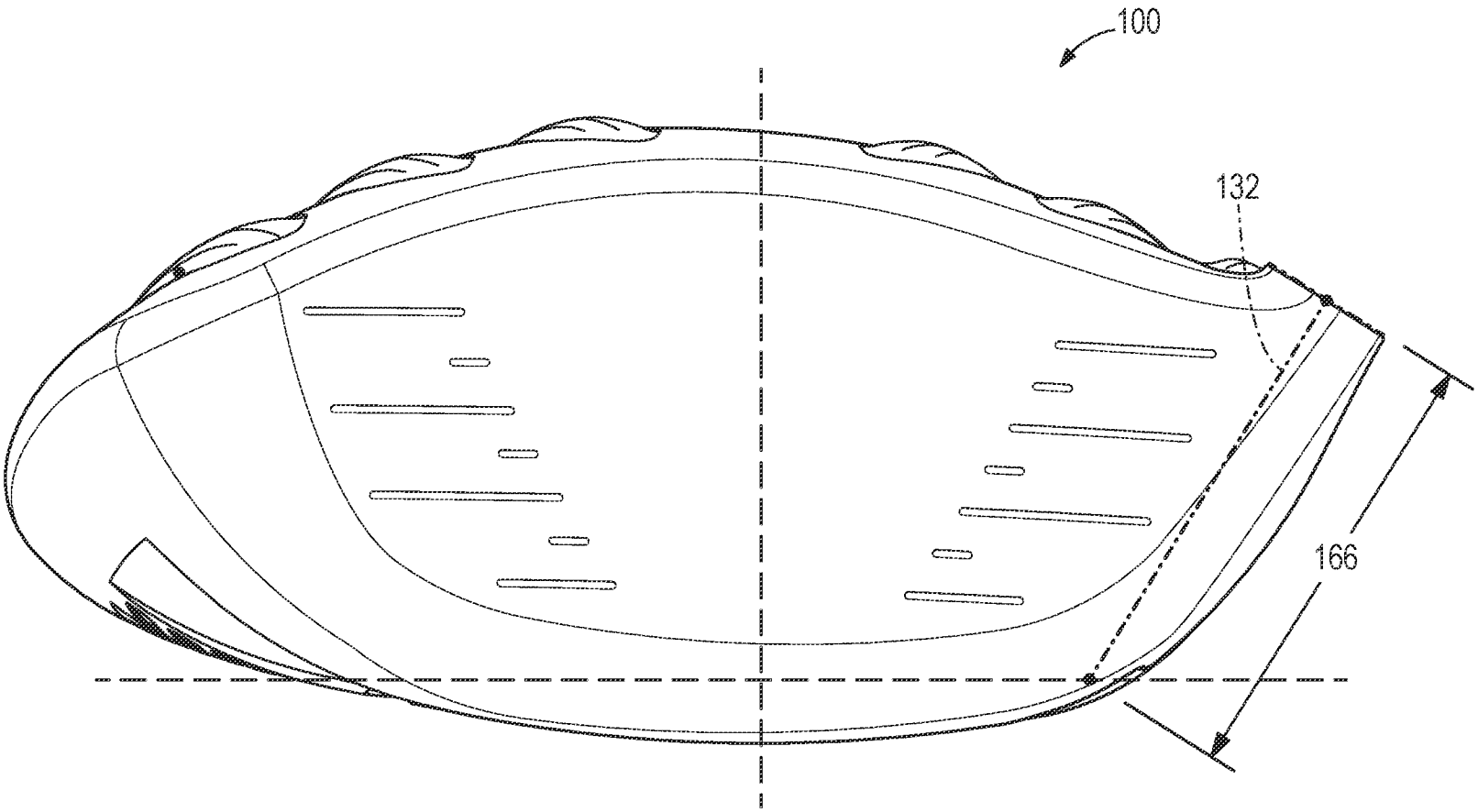
FIG. 9 is a dimensional hosel view of the golf club head of FIG. 1 with an curvature profile.

As described below, embodiments of a club head are described below wherein the golf club head comprises a sole contour with a smaller radius of curvature resembling a typical crown and a larger radius of curvature for the crown contour, resembling a typical sole. FIGS. 1A, 1B, 2, 3, 4, and 10 illustrate additional features that can be applied in conjunction (any combination thereof) with the golf club head having the curvature profile described herein, and as applied to club head 100, to improve performance. The club head 100 comprises a curvature profile, wherein the crown curvature matches the sole curvature of a standard club head (such as club head 100') and the sole curvature matches the crown curvature of a standard club head (such as club head 100') to reduce the CG height and increase the CG depth. FIGS. 5, 7A, and 8 show club head 100' having a standard curvature profile as compared to the embodiment comprising the curvature profile of club head 100 as described herein, and as shown in FIGS. 6, 7B, and 9. In many embodiments, the head CG 170180 is strategically positioned toward the sole 118 and back end 110 of the club head 100 based on various club head parameters, such as volume and loft angle 155, as described below. Further, in many embodiments, the head CG 180 is strategically positioned toward the sole 118 and back end 110 of the club head 100 in combination with reduced aerodynamic drag.

Club head 100 comprises a body 102 and a strikeface 104. The body 102 of the club head 100 includes a front end 108, a back end 110 opposite the front end 108, a crown 116, a sole 118 opposite the crown 116, a heel 120 and a toe 122 opposite the heel 120. The body 102 further includes a skirt or trailing edge 128 located between and adjoining the crown 116 and the sole 118, the skirt extending from near the heel 120 to near the toe 122 of the club head 100.

In many embodiments, the club head 100 is a driver-type club head. In other embodiments, a similar curvature profile can be applied to any hollow body club head (e.g. a driver, fairway wood, or hybrid). In these embodiments, the body and strikeface can define an internal cavity of the golf club head 100. In some embodiments, the body 102 can extend over the crown 116, the sole 118, the heel 120, the toe 122, the back end 110, and the perimeter of the front end 108 of the club head 100. In these embodiments, the body 102 defines an opening on the front end 108 of the club head 100 and the strikeface 104 is positioned within the opening to form the club head 100. In other embodiments, the strikeface 104 can extend over the entire front end 108 of the club head and can include a return portion extending over at least one of the crown 116, the sole 118, the heel 120, and the toe 122. In these embodiments, the return portion of the strikeface 104 is coupled to the body 102 to form the club head 100.

Figure 2:
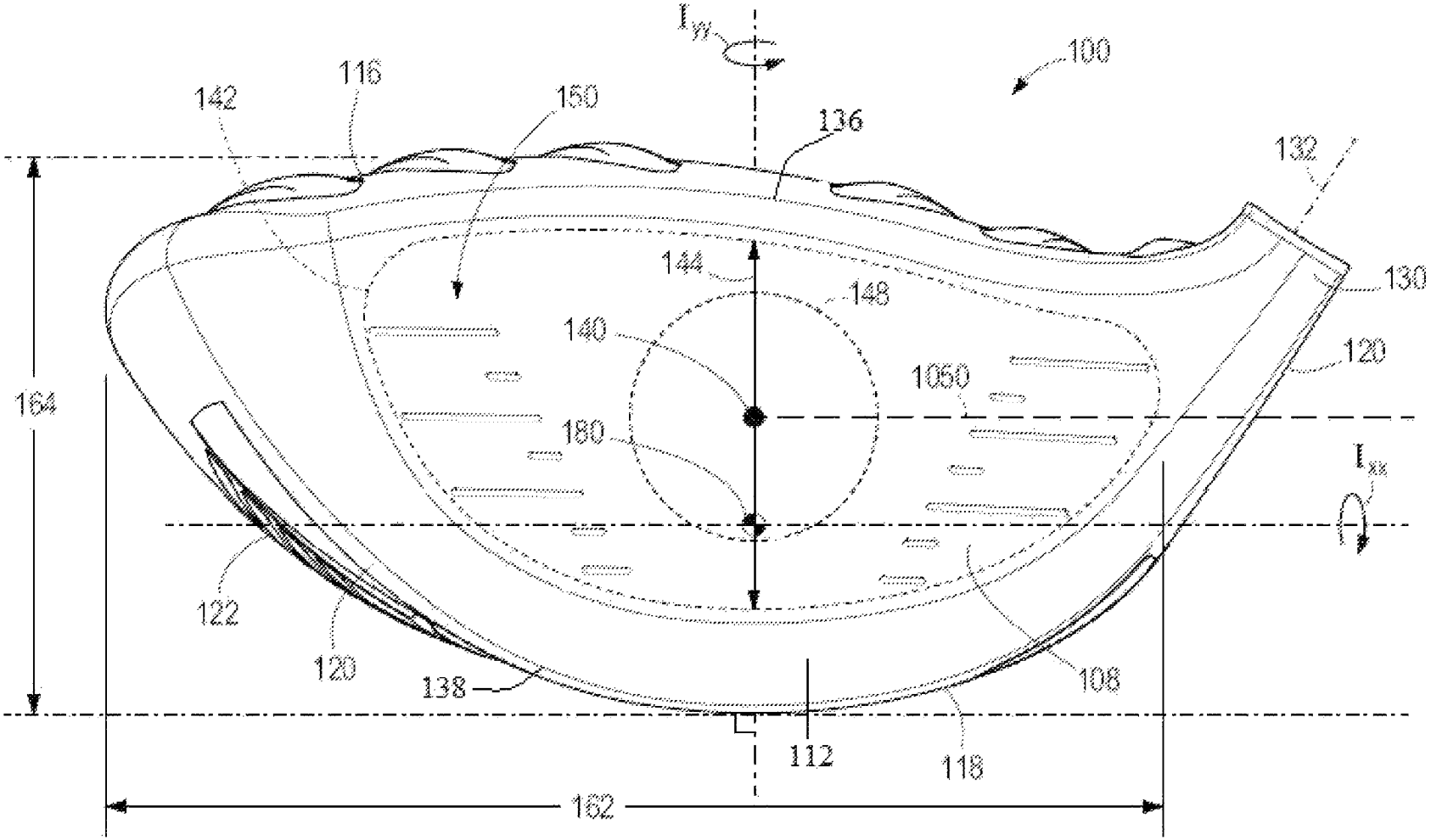
FIG. 2 is a front view of the golf club head in FIG. 1.

As shown in FIGS. 2, 7B, and 9 the club head 100 further comprises a hosel structure 130 and a hosel axis 132 extending centrally along a bore of the hosel structure 130. In the present example, a hosel coupling mechanism of the club head 100 comprises the hosel structure 130 and a hosel sleeve 134, where the hosel sleeve 134 can receive an end of a golf shaft 136. The hosel sleeve 134 can couple with the hosel structure 130 in a plurality of configurations, thereby permitting the golf shaft 136 to be secured to the hosel structure 130 at a plurality of angles relative to the hosel axis 132. Each angle denotes a different, pre-identified loft angle and lie angle combination. There can be other examples, however, where the shaft 136 can be non-adjustably secured to the hosel structure 130.

The club head 100 comprises a balance of various parameters, such as head CG position, club head moment of inertia, crown and sole curvature, and aerodynamic drag, to provide both improved impact performance characteristics (e.g. spin, launch angle, speed, forgiveness) and swing performance characteristics (e.g. aerodynamic drag, ability to square the club head at impact). In many embodiments, the balance of parameters described below provides improved impact performance while maintaining or improving swing performance characteristics and aerodynamic properties. Further, in many embodiments, the balance of parameters described below provides improved swing performance characteristics while maintaining or improving impact performance characteristics.

Various embodiments of the club head having varied loft angles and volumes are described below. Other embodiments can include club heads having loft angles or volumes different than the loft angles and volumes described herein. According to one example, a golf club head 100 is a driver-type golf club head that comprises a high volume and a low loft angle. In other embodiments, the golf club head 100 can comprise any type of golf club head having a loft angle and volume as described below. In many embodiments, club head 100 comprises the same or similar parameters as club head 100.

I. Driver-Type Club Head

The curvature profile increases the heel to toe sole radius of curvature 158, flattening the sole, while decreasing a heel to toe crown radius of curvature 156, thereby increasing the curvature of the crown. The club head 100 having the reduced head CG height 174 can reduce the backspin of a golf ball on impact compared to a similar club head having a higher head CG height.

Referring to FIGS. 1A, 1B, 2, and 3, the strike face 108 includes a top edge 136, a bottom edge 138, and a geometric center 140. The top edge 136 extends along the front end 112 of the strikeface 104 near the crown 124 where the curvature deviates from the bulge and roll of the strike face 108. The bottom edge 138 extends along the front end 112 of the strikeface 104 near the sole 132 where the curvature deviates from the bulge and roll of the strike face 108. In some embodiments, the spline method can be used to determine where the curvature deviates from the bulge and roll of the strike face 108 at the top edge 136 or at the bottom edge 138.

i. Crown Heel to Toe Radius of Curvature

Referring to FIGS. 5 and 6, the club head 100 further includes a heel to toe crown radius of curvature 156 positioned on the front end 112 extending from near the heel 116120 to near the toe 120122 when viewed from a front view (perpendicular and intersecting the crown transition region). In many embodiments, decreasing the heel to toe crown radius of curvature 156 can further reduce the aerodynamic drag of the club head 100 during a swing. More importantly, the heel to toe crown radius of curvature 156 helps strategically position the CG height and CG depth, in order to maximize the launch and spin imparted on a golf ball struck by club head 100. In reference to FIGS. 5 and 6, it can be seen that the heel to toe crown radius of curvature 156 of golf club head 100 in FIG. 6, is much more curved than the heel to toe crown radius of curvature 156' of the golf club head in FIG. 5, devoid of the curvature profile (the heel to toe crown radius of curvature 156, of FIG. 6, is flatter).

In the illustrated embodiment of FIG. 6, the heel to toe radius of curvature extends along the entire top edge 136 of the strike face 108 from near the heel 120 to near the toe 122. In other embodiments, the heel to toe radius of curvature can extend along a portion of the top edge 136 of the strike face 108.

In the illustrated embodiment, the heel to toe crown radius of curvature 156 can be approximately 4.0 inches to reduce aerodynamic drag compared to a similar club head having a greater (than 4.0 inches) heel to toe crown radius of curvature 156. In other embodiments, aerodynamic drag on the club head 100 can be reduced with a heel to toe crown radius of curvature 156 less than approximately 3.8 inches, less than approximately 3.9 inches, less than approximately 4.0 inches, less than approximately 4.1 inches, less than approximately 4.2 inches, less than approximately 4.3 inches, less than approximately 4.4 inches, less than approximately 4.5 inches, less than approximately 4.6 inches, less than approximately 4.7 inches, less than 4.8 inches, less than approximately 4.9 inches, less than approximately 5.0 inches, or less than approximately 5.1 inches. Further, in other embodiments, aerodynamic drag on the club head 100 can be reduced with a heel to toe radius of curvature between approximately 3.0-3.5 inches, between 3.25 and 3.75 inches, between 3.5 and 4.0 inches, between 3.75 and 4.25 inches, between 4.0 and 4.5 inches, between 4.25 and 4.75 inches, or between 4.5 and 5.0 inches.

The decreased heel to toe crown radius of curvature 156 results in a more curved shape of the crown region in a heel to toe direction when viewed from a front view, compared to a similar club head having a greater heel to toe radius of curvature. The curved crown shape maintains laminar flow and reduces turbulent flow over the heel and toe regions of the crown to reduce the aerodynamic drag on the club head 100, while helping lower the center of gravity of the total club head.

ii. Sole Heel to Toe Radius of Curvature

Referring to FIGS. 5 and 6, the club head 100 further includes a heel to toe sole radius of curvature 158 positioned on the front end 112 extending from near the heel 116 to near the toe 120 when viewed from a front view (perpendicular and intersecting the sole transition region). In many embodiments, increasing the heel to toe sole radius of curvature 158 can further reduce the aerodynamic drag of the club head 100 during a swing, when combined with the reduced heel to toe crown radius of curvature 156. More importantly, the heel to toe sole radius of curvature 158 helps strategically position the CG height and CG depth, in order to maximize the launch and spin imparted on a golf ball struck by club head 100. The heel to toe sole radius of curvature 158 in FIG. 6 is reduced in comparison to the golf club head of FIG. 7, which does not comprise an curvature profile. In reference to FIGS. 5 and 6, it can be seen that the heel to toe sole radius of curvature 158 of golf club head 100 in FIG. 6, is flatter than the golf club head in FIG. 5, devoid of the curvature profile (the heel to toe sole radius of curvature 158 is more curved).

Referring to FIG. 6, in the illustrated embodiment, the heel to toe sole radius of curvature 158 extends along a portion of the bottom edge 138 (not shown) of the strike face 108 from near the heel 116 to near the toe 120. In other embodiments, the heel to toe radius of curvature can extend along the entirety of the bottom edge 138 of the strike face 108.

Increasing the heel to toe sole radius of curvature 158 can reduce aerodynamic drag on a golf club head during a swing, while simultaneously lowering the CG, by increasing the mass located near the sole. In the illustrated embodiment, the heel to toe sole radius of curvature 158 can approximately 6.0 inches to reduce aerodynamic drag compared to a similar club head having a lower (less than 6.0 inches) heel to toe radius of curvature. In other embodiments, aerodynamic drag on the club head 100 is reduced with a heel to toe sole radius of curvature 158 greater than approximately 4.9 inches, greater than approximately 5.2 inches, greater than approximately 5.5 inches, greater than approximately 5.8 inches, greater than approximately 6.0 inches, greater than approximately 6.1 inches, greater than approximately 6.2 inches, greater than approximately 6.3 inches, greater than approximately 6.4 inches, greater than approximately 6.5 inches, greater than approximately 6.6 inches, greater than approximately 6.7 inches, greater than approximately 6.8 inches, greater than 6.9 inches, or greater than approximately 7.0 inches. Further, in other embodiments, aerodynamic drag on the club head 100 can be reduced with a heel to toe sole radius of curvature 158 between approximately 5.0-6.5 inches, between approximately 5.25-6.75 inches, between approximately 5.5-7.0 inches, between approximately 5.75-7.25 inches, between 6.0-7.5 inches, or between 6.25-7.75 inches.

The increased heel to toe sole radius of curvature 158 results in a flattened shape of the sole transition region 146 in a heel to toe direction when viewed from a front view, compared to a similar club head having a lower heel to toe radius of curvature. The flattened shape of the sole, and the increased curvature of the crown, maintains laminar flow and reduces turbulent flow over the heel and toe regions of the crown to reduce the aerodynamic drag on the club head 100, while helping lower the center of gravity of the total club head. In most embodiments, the reduced heel to toe crown radius of curvature 156 and increased heel to toe sole radius of curvature 158 can reduce the CG height by approximately 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, or more, over a club head without curvature profiles (FIGS. 5, 7A, and 8). In one embodiment, reducing the heel to toe crown radius of curvature 156 from 6.325 inches (seen in FIG. 7) to 4.0 inches (seen in FIG. 8), and increasing the heel to toe sole radius of curvature 158 to 6.0 inches (seen in FIG. 8), from 3.3 inches (seen in FIG. 7), can drop the CG Height by 0.188 inches, which corresponds to an 18.87% lower CG height.

Furthermore, the curvature profile not only drastically reduces the CG height but can increase the CG depth of the club head 100, since more discretionary mass can be located down and back. In most embodiments, the reduced heel to toe crown radius of curvature 156 and increased heel to toe sole radius of curvature 158, maintains the desirable CG depth that is achieved by placing a large amount of mass far from the strike face. However, in some embodiments, the reduced heel to toe crown radius of curvature 156 and increased heel to toe sole radius of curvature 158, can increase the CG depth by approximately 0.3%, 0.4%, 0.5%, 0.6%, 0.7%, 0.8%, 0.9%, 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, or more, over a club head without curvature profiles (FIGS. 5A, 6A, 7, and 10). In the same embodiment, reducing the heel to toe crown radius of curvature 156 from 6.325 inches (seen in FIG. 7) to 4.0 inches (seen in FIG. 8), and increasing the heel to toe sole radius of curvature 158 to 6.0 inches (seen in FIG. 8), from 3.3 inches (seen in FIG. 7), increases the CG depth by 0.010 inches, which corresponds to an 0.477% improvement of the CG height.

The reduction in CG height and increase of CG depth, leads to a 0.25 mph increase in ball speed, a reduction in spin of at least 350 rpm, and an increase in launch angle of 0.25 to 1 degree. These improvements, due to the lower CG height and increased CG depth, lead to an increase ball flight distance of 5-7 yards. In other embodiments, the reduction of CG height and increase in CG depth can reduce the spin by 25 rpm, 50 rpm, 75 rpm, 100 rpm, 125 rpm, 150 rpm, 175 rpm, 200 rpm, 225 rpm, 250 rpm, 275 rpm, 300 rpm, 325 rpm, 350 rpm, 375 rpm, 400 rpm, or more than 400 rpm. In other embodiments, the reduction of CG height and increase in CG depth can increase the launch angle of the golf ball by 0.1 degree, 0.15 degree, 0.20 degree, 0.25 degree, 0.30 degree, 0.35 degree, 0.40 degree, 0.45 degree, 0.50 degree, 0.55 degree, 0.60 degree, 0.65 degree, 0.70 degree, 0.75 degree, 0.80 degree, 0.85 degree, 0.90 degree, 0.95 degree, 1 degree or more than 1 degree.

In order to further improve CG position and aerodynamic properties to reduce backspin and increase ball flight distance, golf club head 100 can include any one or combination of the additional features described below.

iii. Steep Crown Angle

Figure 10:
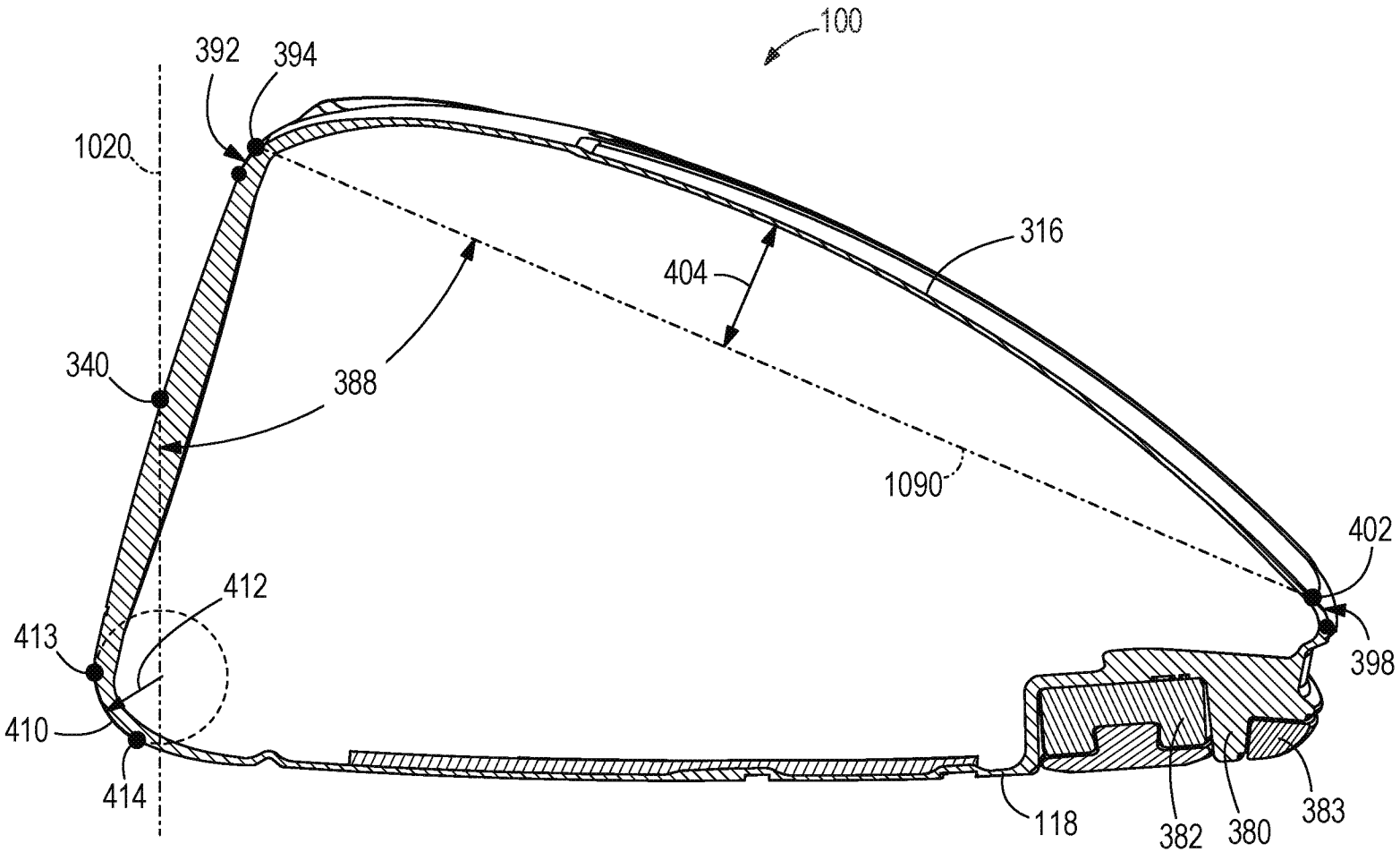
FIG. 10 is a side cross-sectional view of the golf club head of FIG. 1.

Other attributes can be combined with the golf club head 100 having the heel to toe crown and sole curvatures specified above. Reference to figures depicting a standard driver club heads is made, but the attributes described below, and illustrated in the figures, can be applied to club head 100 with curvature profiles. Referring to FIG. 10, in some embodiments, the golf club head 100, comprising the curvatures described above, can further include a steep crown angle 388 to achieve a lower and further back head CG position. The steep crown angle 388 positions the back end of the crown 116 toward the sole 118 or ground, thereby lowering the club head CG position.

The crown angle 388 is measured as the acute angle between a crown axis 1090 and the front plane 1020. In these embodiments, the crown axis 1090 is located in a cross-section of the club head taken along a plane positioned perpendicular to the ground plane 1030 and the front plane 1020. The crown axis 1090 can be further described with reference to a top transition boundary and a rear transition boundary, as defined below.

The club head 100 includes a top transition boundary extending between the front end 108 and the crown 116 from near the heel 120 to near the toe 122. The top transition boundary includes a crown transition profile 390 when viewed from a side cross sectional view taken along a plane perpendicular to the front plane 1020 and perpendicular to the ground plane 1030 when the club head 100 is at an address position. The side cross sectional view can be taken along any point of the club head 100 from near the heel 120 to near the toe 122.

The club head 100 further includes a rear transition boundary extending between the crown 116 and the skirt 128 from near the heel 120 to near the toe 122. The rear transition boundary includes a rear transition profile 396 when viewed from a side cross sectional view taken along a plane perpendicular to the front plane 1020 and perpendicular to the ground plane 1030 when the club head 100 is at an address position. The cross sectional view can be taken along any point of the club head 100 from near the heel 120 to near the toe 122.

The crown axis 1090 extends between a crown transition point 394 near the front end 108 of the club head 100 and a rear transition point 402 near the back end 110 of the club head 100, as described below. The crown angle 388 can remain constant, or can vary from near the heel 120 to near the toe 122 of the club head 100. For example, the crown angle 388 can vary when the side cross sectional view is taken at different locations relative to the heel 120 and the toe 122.

In the illustrated embodiment, the crown angle 388 near the toe 122 is approximately 72.25 degrees, the crown angle 388 near the heel 120 is approximately 64.5 degrees, and the crown angle 388 near the center of the golf club head is approximately 64.2 degrees. In many embodiments, the maximum crown angle 388 taken at any location from near the toe 122 to near the heel 120 is less than 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, in some embodiments, the maximum crown angle is between 50 degrees and 79 degrees, between 60 degrees and 79 degrees, or between 70 degrees and 79 degrees.

In other embodiments, the crown 388 angle near the toe 122 of the club head 100 can be less than approximately 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, the crown angle 388 taken along a side cross sectional view positioned approximately 1.0 inch toward the toe 122 from the geometric center 340 of the strikeface 104 can be less than 79 degrees, less than 78 degrees, less than 77 degrees, less than 76 degrees, less than 75 degrees, less than 74 degrees, less than 73 degrees, less than 72 degrees, less than 71 degrees, less than 70 degrees, less than 69 degrees, or less than 68 degrees.

Further, in other embodiments, the crown angle 388 near the heel 120 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 388 taken along a side cross sectional view positioned approximately 1.0 inch toward the heel 120 from the geometric center 340 of the strikeface 104 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

Further still, in other embodiments, the crown angle 388 near the center of the club head 100 can be less than 75 degrees, less than 74 degrees, less than 73 degrees, less than 72 degrees, less than 71 degrees, less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 388 taken along a side cross sectional view positioned approximately at the geometric center 340 of the strikeface 104 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. In one example, the crown angle 388 near the center of the club head 100 is 68.66 degrees.

In many embodiments, reducing the crown angle 388 compared to current club heads generates a steeper crown or a crown positioned closer to the ground plane 1030 when the club head 100 is at an address position. Accordingly, the reduced crown angle 388 can result in a lower head CG position compared to a club head with a higher crown angle, especially when reduced, in junction with the aforementioned curvature profile.

vii. Transition Profiles

In some embodiments, the golf club head 100, comprising the heel to toe crown and sole curvatures described above, can further include transition profiles, including front to rear radii of curvature as described below. In many embodiments, the transition profiles of the club head 100 from the strikeface 104 to the crown 116, the strikeface 104 to the sole 118, and/or the crown 116 to the sole 118 along the back end 110 of the club head 100 can affect the aerodynamic drag on the club head 100 during a swing.

Referring to FIG. 10, in some embodiments, the club head 100 having the top transition boundary defining the crown transition profile 390, and the rear transition boundary defining the rear transition profile 396 further includes a sole transition boundary defining a sole transition profile 410. The sole transition boundary extends between the front end 108 and the sole 118 from near the heel 120 to near the toe 122. The sole transition boundary includes a sole transition profile 410 when viewed from a side cross sectional view taken along a plane parallel to the Y'Z' plane. The side cross sectional view can be taken along any point of the club head 100 from near the heel 120 to near the toe 122.

The sole transition profile defines a strikeface to rear sole radius of curvature 412 extending from the front end 108 of the club head 100 where the contour departs from the roll radius and/or the bulge radius of the strikeface 104 to a sole transition point 414 indicating a change in curvature from sole radius of curvature 412 to the curvature of the sole 118. In some embodiments, the sole radius of curvature comprises a single radius of curvature extending from the bottom end of the strikeface perimeter near the sole 118 where the contour departs from the roll radius and/or the bulge radius of the strikeface 104 to a sole transition point 414 indicating a change in curvature from the sole radius of curvature 412 to a curvature of the sole 118.

The crown transition profile 390 defines a strikeface to rear front radius of curvature 392 extending from the front end 108 of the club head 100 where the contour departs from the roll radius and/or the bulge radius of the strikeface 104 to a crown transition point 394 indicating a change in curvature from the front radius of curvature 392 to the curvature of the crown 116. In some embodiments, the front radius of curvature 392 comprises a single radius of curvature extending from the top end 393 of the strikeface perimeter 342 near the crown 116 where the contour departs from the roll radius and/or the bulge radius of the strikeface 104 to a crown transition point 394 indicating a change in curvature from the front radius of curvature 392 to one or more different curvatures of the crown 116.

The front radius of curvature 392 of the top transition boundary can remain constant, or can vary from near the heel 120 to near the toe 122 of the club head 100. Similarly, the rear radius of curvature 398 of the rear transition boundary can remain constant, or can vary from near the heel 120 to near the toe 122 of the club head 100.

Referring to FIG. 10, the rear transition profile 396 defines a rear radius of curvature 398 extending from the crown 116 to the skirt 128 of the club head 100. In many embodiments, the rear radius of curvature 398 comprises a single radius of curvature that transitions the crown 116 to the skirt 128 of the club head 100 along the rear transition boundary. A first rear transition point 402 is located at the junction between the crown 116 and the rear transition boundary. A second rear transition point 403 is located at the junction between the rear transition boundary and the skirt 128 of the club head 100.

In many embodiments, the crown transition profile 390, the sole transition profile, and the rear transition profile can be similar to the crown transition, sole transition, and rear transition profiles described in U.S. patent Ser. No. 15/233,486, entitled "Golf Club Head with Transition Profiles to Reduce Aerodynamic Drag." Further, the front radius of curvature 392 can be similar to the first crown radius of curvature, the sole radius of curvature 412 can be similar to the first sole radius of curvature, and the rear radius of curvature 398 can be similar to the rear radius of curvature described U.S. patent Ser. No. 15/233,486, entitled "Golf Club Head with Transition Profiles to Reduce Aerodynamic Drag."

In some embodiments, front radius of curvature 392 can range from approximately 0.18 to 0.30 inch (0.46 to 0.76 cm). Further, in other embodiments, the front radius of curvature 392 can be less than 0.30 inch (1.02 cm), less than 0.275 inch (0.95 cm), less than 0.25 inch (0.89 cm), less than 0.225 inch (0.83 cm), or less than 0.20 inch 0.76 cm). For example, the front radius of curvature 392 may be approximately 0.18 inch (0.46 cm), 0.20 inch (0.51 cm), 0.22 inch (0.66 cm), 0.24 inch (0.61 cm), 0.26 inch (0.66 cm), 0.28 inch (0.71 cm), or 0.30 inch (0.76 cm). In one example, the front radius of curvature 392 is 0.24 inch.

In some embodiments, the sole radius of curvature 412 can range from approximately 0.25 to 0.50 inch (0.76 to 1.27 cm). For example, the sole radius of curvature 412 can be less than approximately 0.5 inch (1.27 cm), less than approximately 0.475 inch (1.21 cm), less than approximately 0.45 inch (1.14 cm), less than approximately 0.425 inch (1.08 cm), or less than approximately 0.40 inch (1.02 cm). For further example, the sole radius of curvature 412 can be approximately 0.30 inch (0.76 cm), 0.35 inch (0.89 cm), 0.40 inch (1.02 cm), 0.45 inch (1.14 cm), or 0.50 inch (1.27 cm).

In some embodiments, the rear radius of curvature 398 can range from 0.10 inch to 0.30 inch. For example, the rear radius of curvature can be less than approximately 0.3 inches (0.76 cm), less than approximately 0.275 inches (0.70 cm), less than approximately 0.25 inches (0.64 cm), less than approximately 0.225 inches (0.57 cm), or less than approximately 0.20 inches (0.51 cm). For further example, the rear radius of curvature 398 can be approximately 0.10 inches (0.25 cm), 0.15 inches (0.38 cm), 0.20 inches (0.51 cm), or 0.25 inches (0.64 cm). In one example, the rear radius of curvature 398 is 0.18 inch.

iv. Crown Height

In some embodiments, the golf club head 100, comprising the heel to toe crown and sole curvatures described above, can further include an increased crown height 404 as described below. In some embodiments, reducing the crown angle 388 to form a steeper crown and lower head CG position may result in an undesired increase in aerodynamic drag due to increased air flow separation over the crown during a swing. To prevent increased drag associated with a reduced crown angle 388, a maximum crown height 404 can be increased. Referring to FIG. 10, the maximum crown height 404 is the greatest distance between the surface of the crown 116 and the crown axis 1090 taken at any side cross sectional view of the club head 100 along a plane positioned parallel to the Y'Z' plane. In many embodiments, a greater maximum crown height results in the crown 116 having a greater curvature. A greater curvature in the crown 116 moves the location of the air flow separation during a swing further back on the club head 100. In other words, a greater curvature allows the airflow to stay attached to club head 100 for a longer distance along the crown 116 during a swing. Moving the airflow separation point back on the crown 116 can result in reduced aerodynamic drag and increased club head swing speeds, thereby resulting in increased ball speed and distance.

In many embodiments, the maximum crown height 404 can be greater than approximately 0.20 inch (5 mm), greater than approximately 0.30 inch (7.5 mm), greater than approximately 0.40 inch (10 mm), greater than approximately 0.50 inch (12.5 mm), greater than approximately 0.60 inch (15 mm), greater than approximately 0.70 inch (17.5 mm), greater than approximately 0.80 inch (20 mm), greater than approximately 0.90 inch (22.5 mm), or greater than approximately 1.0 inch (25 mm). Further, in other embodiments, the maximum crown height can be within the range of 0.40 inch (5 mm) to 0.60 inch (15 mm), or 0.40 inch (10 mm) to 0.80 inch (20 mm), or 0.60 inch (15 mm) to 1.0 inch (25 mm). For example, in some embodiments, the maximum crown height can be approximately 0.50 inch, 0.51 inch, 0.52 inch (13.3 mm), approximately 0.54 inch (13.8 mm), approximately 0.59 inch (15 mm), approximately 0.65 inch (16.5 mm), or approximately 0.79 inch (20 mm). In one example, the crown height is 0.501 inch.

v. Center of Gravity Position and Moment of Inertia

In some embodiments, the golf club head 100, comprising the heel to toe crown and sole curvatures described above, can further include a high moment of inertia and relationships between CG and MOI as described below. In many embodiments, a low and back club head CG and an increased moment of inertia can be achieved by increasing discretionary weight and repositioning discretionary weight in regions of the club head having maximized distances from the head CG. Increasing discretionary weight can be achieved by thinning the crown and/or using optimized materials, as described above relative to the head CG position. In some examples, repositioning discretionary weight to maximize its distance from the head CG can be achieved using removable weights, internal mass structures, a steep crown angle, and curvature optimization as described above relative to the head CG position. Additional mass can be located down and back by optimizing the curvature profile, flattening a heel to toe radius of curvature, and increasing the curvature of a heel to toe crown radius of curvature 156. Redistribution of mass by restructuring as detailed above improves aerodynamic properties of the club head while lowering CG and increasing CG depth.

In many embodiments, the club head 100 comprises a crown-to-sole moment of inertia, $I_{xx}$, greater than approximately 3000 g·cm$^2$, greater than approximately 3250 g·cm$^2$, greater than approximately 3500 g·cm$^2$, greater than approximately 3750 g·cm$^2$, greater than approximately 4000 g·cm$^2$, greater than approximately 4250 g·cm$^2$, greater than approximately 4500 g·cm$^2$, greater than approximately 4750 g·cm$^2$, greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 100 comprises a heel-to-toe moment of inertia $I_{yy}$ greater than approximately 5000 g·cm$^2$, greater than approximately 5250 g·cm$^2$, greater than approximately 5500 g·cm$^2$, greater than approximately 5750 g·cm$^2$, greater than approximately 6000 g·cm$^2$, greater than approximately 6250 g·cm$^2$, greater than approximately 6500 g·cm$^2$, greater than approximately 6750 g·cm$^2$, or greater than approximately 7000 g·cm$^2$.

In many embodiments, the club head 100 comprises a combined moment of inertia (i.e. the sum of the crown-to-sole moment of inertia $I_{xx}$ and the heel-to-toe moment of inertia $I_{yy}$) greater than 8000 g·cm$^2$, greater than 8500 g·cm$^2$, greater than 8750 g·cm$^2$, greater than 9000 g·cm$^2$, greater than 9250 g·cm$^2$, greater than 9500 g·cm$^2$, greater than 9750 g·cm$^2$, greater than 10000 g·cm$^2$, greater than 10250 g·cm$^2$, greater than 10500 g·cm$^2$, greater than 10750 g·cm$^2$, greater than 11000 g·cm$^2$, greater than 11250 g·cm$^2$, greater than 11500 g·cm$^2$, greater than 11750 g·cm$^2$, or greater than 12000 g·cm$^2$, greater than 12500 g·cm$^2$, greater than 1300 g·cm$^2$, greater than 13500 g·cm$^2$, or greater than 1400 g·cm$^2$.

In many embodiments, the club head 100 comprises a head CG height 174 less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches. Further, in many embodiments, the club head 100 comprises a head CG height 174 having an absolute value less than approximately 0.20 inches, less than approximately 0.15 inches, less than approximately 0.10 inches, less than approximately 0.09 inches, less than approximately 0.08 inches, less than approximately 0.07 inches, less than approximately 0.06 inches, or less than approximately 0.05 inches.

In many embodiments, the club head 100 comprises a head CG depth 172 greater than approximately 1.2 inches, greater than approximately 1.3 inches, greater than approximately 1.4 inches, greater than approximately 1.5 inches, greater than approximately 1.6 inches, greater than approximately 1.7 inches, greater than approximately 1.8 inches, greater than approximately 1.9 inches, or greater than approximately 2.0 inches.

In some embodiments, the club head 100 can comprise a first performance characteristic less than or equal to 0.56, wherein the first performance characteristic is defined as a ratio between (a) the difference between 72 mm and the face height 144, and (b) the head CG depth 172 (see Relation 3 below).

$$\text{Specific Strength} = \frac{72 - \text{Face Height}}{CG\ \text{Depth}} \qquad \text{Relation 3}$$

In these or other embodiments, the club head 100 can comprise a second performance characteristic greater than or equal to 425 cc, wherein the second performance characteristic is defined as the sum of (a) the volume of the club head 100, and (b) a ratio between the head CG depth 172 and the absolute value of the head CG height 174. In some embodiments, the second performance characteristic can be greater than or equal to 450 cc, greater than or equal to 475 cc, greater than or equal to 490 cc, greater than or equal to 495 cc, greater than or equal to 500 cc, greater than or equal to 505 cc, or greater than or equal to 510 cc. For example, the second performance characteristic can be greater between 450 cc and 455 cc, 455 cc and 460 cc, 460 cc and 465 cc, 465 cc and 470 cc, 470 cc and 475 cc, 470 cc and 480 cc, 480 cc and 485 cc, 485 cc and 490 cc, 490 cc and 500 cc, or 500 cc and 510 cc.

The club head 100 comprises an curvature profile that reduces the CG height and increases the CG depth. The curvature profile also increases a heel-to-toe sole radius of curvature 158, flattening the sole 118, while decreasing a heel-to-toe crown radius of curvature 156, thereby increasing the curvature of the crown. The club head 100 with reduced head CG height 174 can reduce the backspin of a golf ball on impact compared to a similar club 100' head having a higher head CG height.

Reduced backspin can improve club head performance by increasing both ball speed and travel distance. Further, the club head 100 having the increased head CG depth 172 can increase the heel-to-toe moment of inertia when compared with a similar club head having a head CG depth nearer to the strikeface. Increasing the heel-to-toe moment of inertia can increase club head forgiveness on impact to improve club head performance. Further still, the club head 100 having the increased head CG depth 172 can increase launch angle of a golf ball on impact by increasing the dynamic loft of the club head at delivery, compared to a similar club head having a head CG depth closer to the strikeface.

The low head CG height 174 and/or high head CG depth 172 defined above can be achieved by reducing weight of the club head in various regions, thereby increasing discretionary weight, and repositioning discretionary weight in strategic regions of the club head to shift the head CG lower and farther back. Various means to reduce and reposition club head weight are described below.

vi. Hosel Structure

In some embodiments, the golf club head 100, comprising the heel to toe crown and sole curvatures described above, can further include a reduced mass hosel structure as described below. In some embodiments, the head CG height 174 and/or head CG depth 172 can be achieved by reducing the mass of the hosel sleeve 134. Removing excess weight from the hosel sleeve 134 results in increased discretionary weight that can be strategically repositioned to regions of the club head 100 to achieve the desired low and back club head CG position.

Reducing the mass of the hosel sleeve 134 can be achieved by thinning the sleeve walls, reducing the height of the hosel sleeve 134, reducing the diameter of the hosel sleeve 134, and/or by introducing voids in the walls of the hosel sleeve 134. In many embodiments, the mass of the hosel sleeve 134 can be less than 6 grams, less than 5.5 grams, less than 5.0 grams, less than 4.5 grams, or less than 4.0 grams. In many embodiments, the club head 100 having the reduced mass hosel sleeve can result in a lower (close to the sole) and farther back (closer to the back end) club head CG position than a similar club head with a heavier hosel sleeve 134.

In some embodiments, the hosel structure 330 can have a smaller outer diameter to reduce the aerodynamic drag on the club head 100 during a swing, compared to a similar club head having a larger diameter hosel structure. In many embodiments, the hosel structure 330 has an outer diameter less than 0.545 inches. For example, the hosel structure 330 can have an outer diameter less than 0.60 inches, less than 0.59 inches, less than 0.58 inches, less than 0.57 inches, less than 0.56 inches, less than 0.55 inches, less than 0.54 inches, less than 0.53 inches, less than 0.52, less than 0.51 inches, or less than 0.50 inches. In many embodiments, the outer diameter of the hosel structure 330 is reduced while maintaining adjustability of the loft angle and/or lie angle of the club head 100.

In reference to FIGS. 7A-9, reducing the height 166 of the hosel, can further improve the low and back CG positioning, that the curvature profile achieves. In order to lower the club head CG height, the curvature profile decreases the heel to toe crown radius of curvature 156 and increases the heel to toe sole radius of curvature 158 (FIGS. 6 and 9), in order to place more mass near the sole of the club head 100, over a golf club head 100' without the curvature profile that does the opposite (FIGS. 5 and 8). In doing so, the height 166 of the hosel must be reduced, to maintain desirable drag characteristics, as well as desirable mass properties (MOI).

In this embodiment, the club head 100 hosel height 166 is measured in a direction from a hosel end to the sole, in a direction parallel to the hosel axis 132. In most embodiments, the hosel height 166 is less than 2.25 inches, less than 2.15 inches, less than 2.05 inches, less than 1.95 inches, less than 1.85 inches, less than 1.75 inches, or less than 1.65 inches. In other embodiments, the hosel height can be between 1.50-1.65 inches, 1.65-1.75 inches, 1.75-1.85 inches, 1.85-1.95 inches, 1.95-2.05 inches, 2.05-2.15 inches, or 2.15-2.25 inches. In most embodiments, the hosel height 166 is between 1.75 inches and 1.85 inches. This shrinking of the hosel height 166 is an improvement, achieve by the curvature profile (see FIGS. 6, 7B, and 9), whereas the hosel height 166' is much greater in a golf club head that does not comprise a more curved sole, and flatter sole (see FIGS. 5, 7A, and 8).

vii. Aerodynamic Drag

The golf club head 100, comprising the heel to toe crown and sole curvatures described above, comprises improved aerodynamic properties as described below. In many embodiments, the club head 100 comprises a low and back club head CG position and an increased club head moment of inertia, in combination with significantly reduced aerodynamic drag.

In many embodiments, the club head 100 experiences an aerodynamic drag force less than approximately 1.2 lbf, less than 1.1 lbf, less than 1.0 lbf, less than 0.9 lbf, less than 0.8 lbf, less than 0.7 lbf, or less than 0.6 lbf when tested in a wind tunnel with a squared face and an air speed of 102 miles per hour (mph). In these or other embodiments, the club head 100 experiences an aerodynamic drag force less than approximately 1.2 lbf, less than 1.1 lbf, less than 1.0 lbf, less than 0.9 lbf, less than 0.8 lbf, less than 0.7 lbf, or less than 0.6 lbf when simulated using computational fluid dynamics with a squared face and an air speed of 102 miles per hour (mph). In these embodiments, the airflow experienced by the club head 100 having the squared face is directed at the strikeface 104 in a direction perpendicular to the X'Y' plane. The club head 100 having reduced aerodynamic drag can be achieved using various means, as described below.

ix. Turbulators

Figure 3:
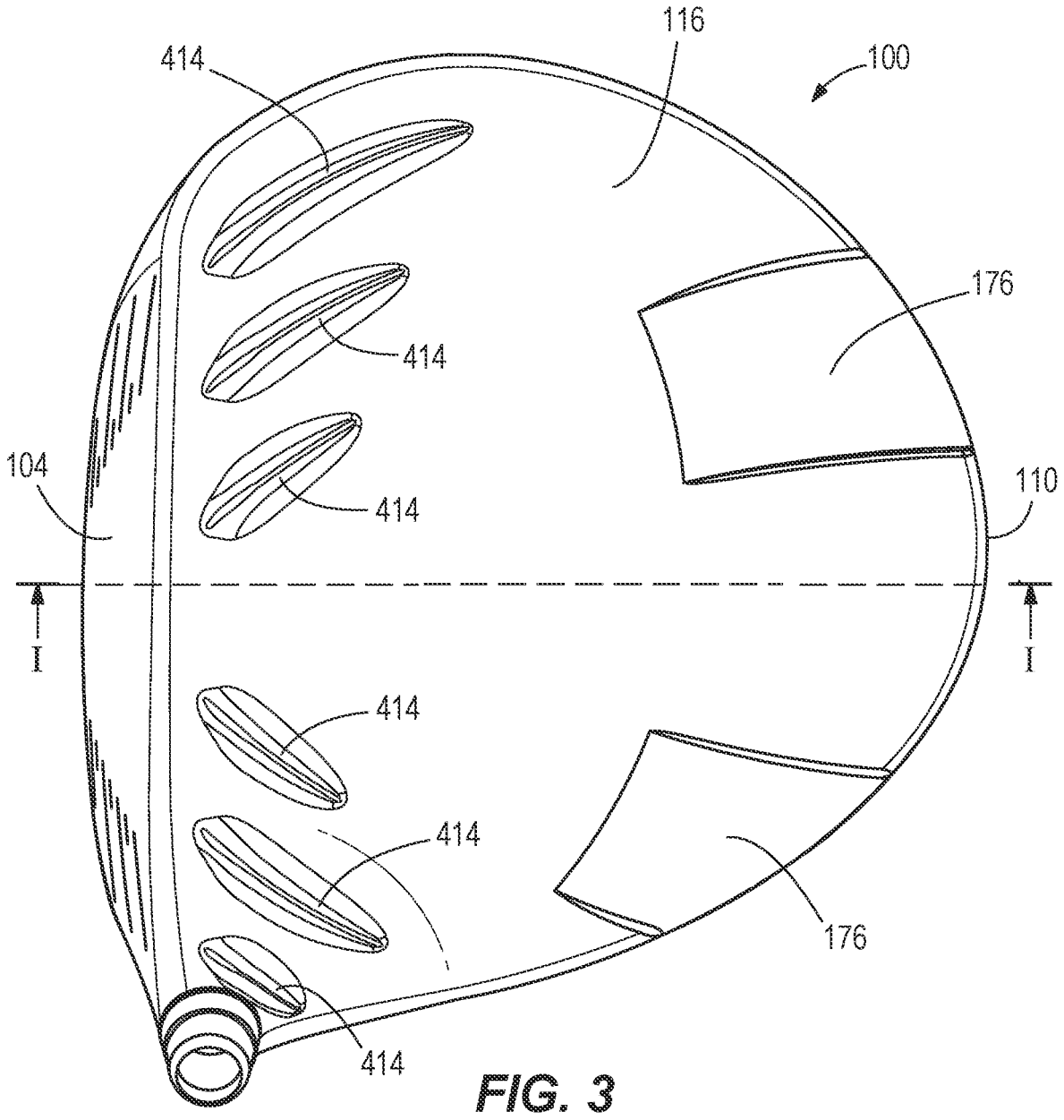
FIG. 3 is a top view of the golf club head in FIG. 1.
Figure 4:
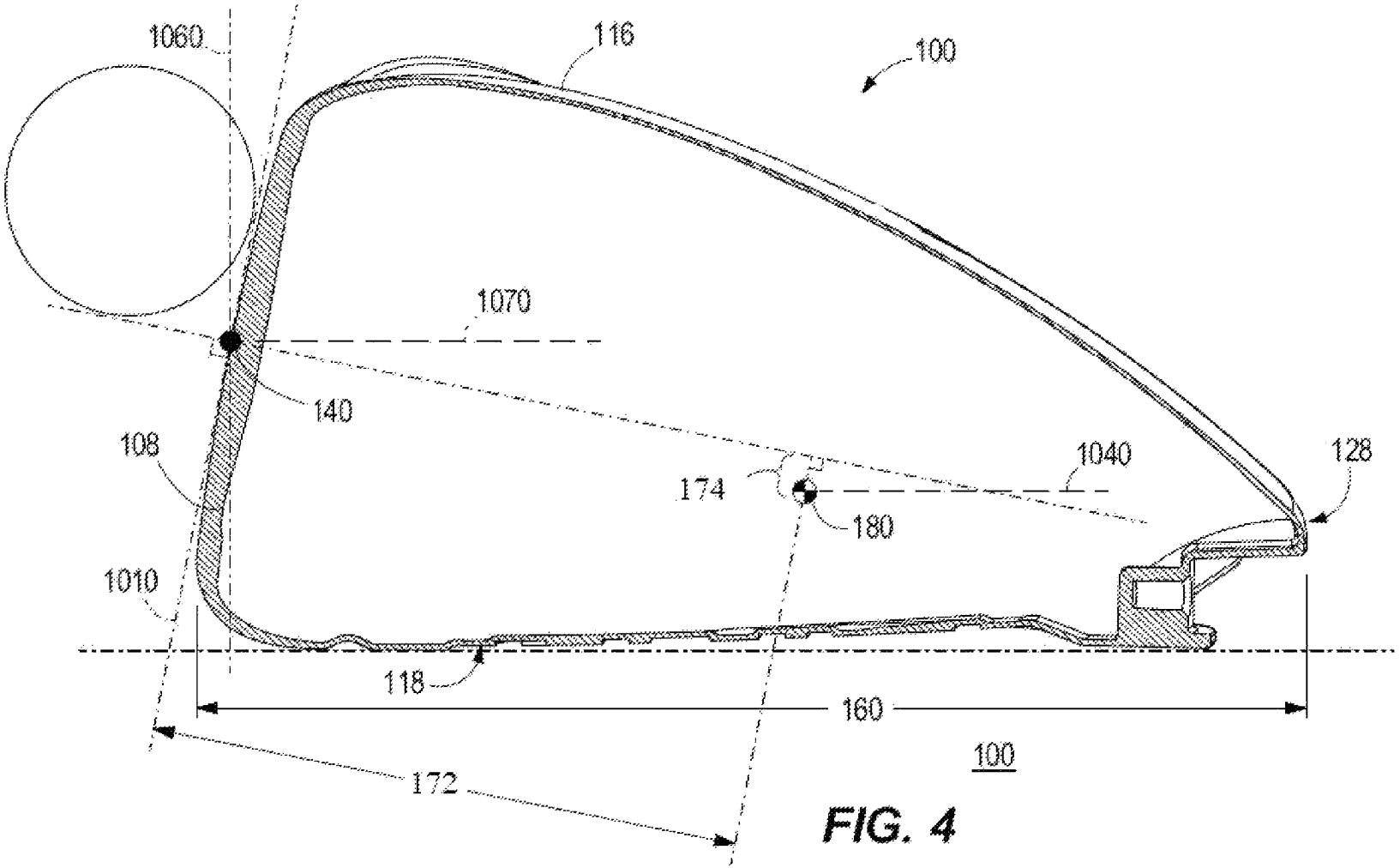
FIG. 4 is a cross-sectional view of the golf club head of FIG. 1, along line I-I.

Referring to FIG. 3, in some embodiments, the club head 100 can further include a plurality of turbulators 414, as described in U.S. patent application Ser. No. 13/536,753, now U.S. Pat. No. 8,608,587, granted on Dec. 17, 2013, entitled "Golf Club Heads with Turbulators and Methods to Manufacture Golf Club Heads with Turbulators," Which is incorporated fully herein by reference. In many embodiments, the plurality of turbulators 414 disrupt the airflow thereby creating small vortices or turbulence inside the boundary layer to energize the boundary layer and delay separation of the airflow on the crown 116 during a swing.

In some embodiments, the plurality of turbulators 414 can be adjacent to the crown transition point 594 of the club head 100. The plurality of turbulators 414 project from an outer surface of the crown 116 and include a length extending between the front end 108 and the back end 110 of the club head 100, and a width extending from the heel 120 to the toe 122 of the club head 100. In many embodiments, the length of the plurality of turbulators 414 is greater than the width. In some embodiments, the plurality of turbulators 414 can comprise the same width. In some embodiments, the plurality of turbulators 414 can vary in height profile. In some embodiments, the plurality of turbulators 414 can be higher toward the apex of the crown 116 than in comparison to the front of the crown 116. In other embodiments, the plurality of turbulators 414 can be higher toward the front of the crown 116, and lower in height toward the apex of the crown 116. In other embodiments, the plurality of turbulators 414 can comprise a constant height profile. Further, in many embodiments, at least a portion of at least one turbulator is located between the strikeface 104 and an apex of the crown 116, and the spacing between adjacent turbulators is greater than the width of each of the adjacent turbulators.

xi. Balance of CG Position, Moment of Inertia, and Aerodynamic Drag

In current golf club head design, increasing or maximizing the moment of inertia of the club head and/or the head CG position can adversely affect other performance characteristics of the club head, such as aerodynamic drag. The club head 100 described herein increases or maximizes the club head moment of inertia, while simultaneously maintaining or reducing aerodynamic drag. Accordingly, the club head 100 having improved impact performance characteristics (e.g. spin, launch angle, ball speed, and forgiveness) also balances or improves swing performance characteristics (e.g. aerodynamic drag, ability to square the club head at impact, and swing speed).

For many known club heads, as the moment of inertia about the x-axis increases, the force of drag increases. For many known club heads, as the moment of inertia about the y-axis increases, the force of drag increases. For many known club heads, as the combined moment of inertia (i.e. the sum of the moment of inertia about the x-axis and the moment of inertia about the y-axis) increases, the force of drag increases.

In the examples of club head 100 and 500 described below, the aerodynamic drag of the club head is measured using computational fluid dynamic simulations with the front end of the club head oriented square into the airstream at an air speed of 102 miles per hour (mph). In other embodiments, the aerodynamic drag can be measured using other methods, such as using wind tunnel testing.

In many known golf club heads, increasing or maximizing the moment of inertia of the club head adversely affects aerodynamic drag. As the club head moment of inertia increases (to increase club head forgiveness), the force of drag during a swing increases (thereby reducing swing speed and ball distance).

The club head 100 described herein increases or maximizes the club head moment of inertia compared to known club head 100' having similar volume and/or loft angle, while simultaneously maintaining or reducing aerodynamic drag. Accordingly, the club head 100 having improved impact performance characteristics (e.g. spin, launch angle, ball speed, and forgiveness) also balances or improves swing performance characteristics (e.g. aerodynamic drag, ability to square the club head at impact, and swing speed).

In many embodiments, referring to FIG. 1, the club head 100 satisfies one or more of the following relations, such that the combined moment of inertia ($I_{xx}+I_{yy}$) of the club head is increased, while maintaining or reducing the drag force (FD) on the club head, compared to known golf club heads having similar volume and/or loft angle.

$$\frac{F_D + 2.7}{0.0005(I_{xx} + I_{yy})} < 1 \quad \text{Relation 3}$$

$$\frac{F_D + 3.4}{0.0005(I_{xx} + I_{yy})} < 1 \quad \text{Relation 4}$$

$$\frac{F_D + 3.8}{0.0005(I_{xx} + I_{yy})} < 1 \quad \text{Relation 5}$$

For example, in many embodiments, the club head 100 satisfies Relation 3, and has a combined moment of inertia greater than 9000 g·cm$^2$. In other embodiments, the club head 100 can satisfy Relation 3, and can have a combined moment of inertia greater than 9010 g·cm$^2$, greater than 9025 g·cm$^2$, greater than 9050 g·cm$^2$, greater than 9075 g·cm$^2$, greater than 10000 g·cm$^2$, greater than 10250 g·cm$^2$, greater than 10500 g·cm$^2$, greater than 10750 g·cm$^2$, or greater than 11000 g·cm$^2$.

For further example, in many embodiments, the club head 100 satisfies Relation 3, and has a drag force less than 1.16 lbf. In other embodiments, the club head 100 can satisfy Relation 3, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 100 satisfies Relation 4, and has a combined moment of inertia greater than 9000 g·cm$^2$. In other embodiments, the club head 100 can satisfy Relation 4, and can have a combined moment of inertia greater than 9010 g·cm$^2$, greater than 9025 g·cm$^2$, greater than 9050 g·cm$^2$, greater than 9075 g·cm$^2$, greater than 10000 g·cm$^2$, greater than 10250 g·cm$^2$, greater than 10500 g·cm$^2$, greater than 10750 g·cm$^2$, or greater than 11000 g·cm$^2$.

For further example, in many embodiments, the club head 100 satisfies Relation 4, and has a drag force less than 1.16 lbf. In other embodiments, the club head 100 can satisfy Relation 4, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 100 satisfies Relation 5, and has a combined moment of inertia greater than 9000 g·cm$^2$. In other embodiments, the club head 100 can satisfy Relation 5, and can have a combined moment of inertia greater than 9010 g·cm$^2$, greater than 9025 g·cm$^2$, greater than 9050 g·cm$^2$, greater than 9075 g·cm$^2$, greater than 10000 g·cm$^2$, greater than 10250 g·cm$^2$, greater than 10500 g·cm$^2$, greater than 10750 g·cm$^2$, or greater than 11000 g·cm$^2$.

For further example, in many embodiments, the club head 100 satisfies Relation 5, and has a drag force less than 1.16 lbf. In other embodiments, the club head 100 can satisfy Relation 5, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

xii. CG Position and Aerodynamic Drag

In some embodiments, the golf club head 100, comprising the heel to toe crown and sole curvatures described above, can further experience a low drag force as described below. In many known golf club heads, shifting the CG position farther down and back to increase launch angle of a golf ball and/or to increase club head inertia, can adversely affect other performance characteristics of the club head, such as aerodynamic drag. For many known club heads, as the head CG depth increases, the force of drag on the club head increases.

The club head 100 described herein increases or maximizes the club head CG depth compared to known club heads having similar volume and/or loft angle, while simultaneously maintaining or reducing aerodynamic drag. Accordingly, the club head 100 having improved impact performance characteristics (e.g. spin, launch angle, ball speed, and forgiveness) also balances or improves swing performance characteristics (e.g. aerodynamic drag, ability to square the club head at impact, and swing speed).

In many embodiments, the club head 100 satisfies one or more of the following relations, such that the head CG depth (CGD) is increased, while maintaining or reducing the drag force (FD) on the club head 100, compared to known golf club heads.

$$\frac{F_D + 1.9}{2.1\,CG_D} < 1 \quad \text{Relation 6}$$

$$\frac{F_D + 2.3}{2.1\,CG_D} < 1 \quad \text{Relation 7}$$

$$\frac{F_D + 2.8}{2.1\,CG_D} < 1 \quad \text{Relation 8}$$

For example, in many embodiments, the club head 100 satisfies Relation 6, and has a head CG depth greater than 1.65 inches. In other embodiments, the club head 100 can satisfy Relation 6, and can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, or greater than 1.90 inches.

For further example, in many embodiments, the club head 100 satisfies Relation 6, and has a drag force less than 1.16 lbf. In other embodiments, the club head 100 can satisfy Relation 6, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 100 satisfies Relation 7, and has a combined moment of inertia greater than 9000 g·cm$^2$. In other embodiments, the club head 100 can satisfy Relation 7, and can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, or greater than 1.90 inches.

For further example, in many embodiments, the club head 100 satisfies Relation 7, and has a drag force less than 1.16 lbf. In other embodiments, the club head 100 can satisfy Relation 7, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

For further example, in many embodiments, the club head 100 satisfies Relation 8, and has a combined moment of inertia greater than 9000 g·cm$^2$. In other embodiments, the club head 100 can satisfy Relation 8, and can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, or greater than 1.90 inches.

For further example, in many embodiments, the club head 100 satisfies Relation 8, and has a drag force less than 1.16 lbf. In other embodiments, the club head 100 can satisfy Relation 8, and can have a drag force less than 1.15 lbf, less than 1.10 lbf, less than 1.00 lbf, less than 0.900 lbf, less than 0.800 lbf, less than 0.75 lbf, less than 0.700 lbf, less than 0.600 lbf, or less than 0.500 lbf.

xiii. Moment of Inertia and CG Depth

The combined moment of inertia and/or head CG depth many known golf club heads are limited. For example, many known golf club heads having a volume and/or loft angle similar to club head 100 or club head 100 have a head CG depth less than 1.6 inches and a combined moment of inertia less than 8900 g·cm$^2$. The club head 100 described herein has a greater head CG depth and a greater combined moment of inertia than known club heads having similar volume and/or loft angle, while simultaneously maintaining or reducing aerodynamic drag. Accordingly, the club head 100 having improved impact performance characteristics (e.g. spin, launch angle, ball speed, and forgiveness) also balances or improves swing performance characteristics (e.g. aerodynamic drag, ability to square the club head at impact, and swing speed).

For example, in many embodiments the club head 100 has a head CG depth greater than 1.65 inches and a combined moment of inertia greater than 9000 g·cm$^2$. In other embodiments, the club head 100 can have a head CG depth greater than 1.60 inches, greater than 1.62 inches, greater than 1.64 inches, greater than 1.68 inches, greater than 1.70 inches, greater than 1.72 inches, greater than 1.74 inches, greater than 1.76 inches, greater than 1.78 inches, greater than 1.80 inches, greater than 1.85 inches, greater than 1.90 inches, or greater than 1.95 inches. In one embodiment, the CG depth is greater than 1.91 inches. Further, in other embodiments, the club head 100 can have a combined moment of inertia greater than 9010 g·cm$^2$, greater than 9025 g·cm$^2$, greater than 9050 g·cm$^2$, greater than 9075 g·cm$^2$, greater than 10000 g·cm$^2$, greater than 10250 g·cm$^2$, greater than 10500 g·cm$^2$, greater than 10750 g·cm$^2$, or greater than 11000 g·cm$^2$.

xiv. Thin Regions

In some embodiments, the head CG height 174 and/or head CG depth 172 can be achieved by thinning various regions of the club head 100 to remove excess weight. Removing excess weight results in increased discretionary weight that can be strategically repositioned to regions of the club head 100 to achieve the desired low and back club head CG position.

In many embodiments, the club head 100 can have one or more thin regions 176. The one or more thin regions 176 can be positioned on the strikeface 104, the body 102, or a combination of the strikeface 104 and the body 102 (see FIG. 7). Further, the one or more thin regions 176 can be positioned on any region of the body 102, including the crown 116, the sole 118, the heel 120, the toe 122, the front end 108, the back end 110, the skirt 128, or any combination of the described positions. For example, in some embodiments, the one or more thin regions 176 can be positioned on the crown 116. For further example, the one or more thin regions 176 can be positioned on a combination of the strikeface 104 and the crown 116. For further example, the one or more thin regions 176 can be positioned on a combination of the strikeface 104, the crown 116, and the sole 118. For further example, the entire body 102 and/or the entire strikeface 104 can comprise a thin region 176.

In embodiments where one or more thin regions 176 are positioned on the strikeface 104, the thickness of the strikeface 104 can vary defining a maximum strikeface thickness and a minimum strikeface thickness. In these embodiments, the minimum strikeface thickness can be less than 0.10 inches, less than 0.09 inches, less than 0.08 inches, less than 0.07 inches, less than 0.06 inches, less than 0.05 inches, less than 0.04 inches, or less than 0.03 inches. In these or other embodiments, the maximum strikeface thickness can be less than 0.20 inches, less than 0.19 inches, less than 0.18 inches, less than 0.17 inches, less than 0.16 inches, less than 0.15 inches, less than 0.14 inches, less than 0.13 inches, less than 0.12 inches, less than 0.11 inches, or less than 0.10 inches.

In embodiments where one or more thin regions 176 are positioned on the body 102, the thin regions can comprise a thickness less than approximately 0.020 inch. In other embodiments, the thin regions comprise a thickness less than 0.025 inch, less than 0.020 inch, less than 0.019 inch, less than 0.018 inch, less than 0.017 inch, less than 0.016 inch, less than 0.015 inch, less than 0.014 inch, less than 0.013 inch, less than 0.012 inch, or less than 0.010 inch. For example, the thin regions can comprise a thickness between approximately 0.010-0.025 inch, between approximately 0.013-0.020 inch, between approximately 0.014-0.020 inch, between approximately 0.015-0.020 inch, between approximately 0.016-0.020 inch, between approximately 0.017-0.020 inch, or between approximately 0.018-0.020 inch.

In the illustrated embodiment, the thin regions 176 vary in shape and position and cover approximately 25% of the surface area of club head 100. In other embodiments, the thin regions can cover approximately 10%-30%, approximately 15-35%, approximately 15-25%, approximately 10-25%, approximately 15-30%, or approximately 20-50% of the surface area of club head 900. Further, in other embodiments, the thin regions can cover up to 5%, up to 10%, up to 15%, up to 20%, up to 25%, up to 30%, up to 35%, up to 40%, up to 45%, or up to 50% of the surface area of club head 100. In other embodiments, the crown 116 can comprise one or more thin regions 176, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the crown 116 comprises thin regions 176. For example, in some embodiments, approximately 40-60% of the crown 116 can comprise thin regions 176. For further example, in other embodiments, approximately 50-100%, approximately 40-80%, approximately 35-65%, approximately 30-70%, or approximately 25-75% of the crown 116 can comprise thin regions 176. In some embodiments, the crown 116 can comprise one or more thin regions 176, wherein each of the one or more thin regions 176 become thinner in a gradient fashion. In this exemplary embodiment, the one or more thin regions 176 of the crown 116 extend in a heel-to-toe direction, and each of the one or more thin regions 176 decrease in thickness in a direction from the strikeface 104 toward the back end 110.

In many embodiments, the sole 118 can comprise one or more thin regions 176, such that approximately 64% of the surface area of the sole 118 comprises thin regions 176. In other embodiments, the sole 118 can comprise one or more thin regions 176, such that up to 20%, up to 25%, up to 30%, up to 35%, up to 40%, up to 45%, up to 50%, up to 55%, up to 60%, up to 65%, up to 70%, up to 75%, up to 80%, up to 85%, or up to 90% of the sole 118 comprises thin regions 176. For example, in some embodiments, approximately 40-60% of the sole 118 can comprise thin regions 176. For further example, in other embodiments, approximately 50-100%, approximately 40-80%, approximately 35-65%, approximately 30-70%, or approximately 25-75% of the sole 118 can comprise thin regions 176.

The thinned regions 376 can comprise any shape, such as circular, triangular, square, rectangular, ovular, or any other polygon or shape with at least one curved surface. Further, one or more thinned regions 376 can comprise the same shape as, or a different shape than the remaining thinned regions.

In many embodiments, club head 100 having thin regions can be manufacturing using centrifugal casting. In these embodiments, centrifugal casting allows the club head 100 to have thinner walls than a club head manufactured using conventional casting. In other embodiments, portions of the club head 100 having thin regions can be manufactured using other suitable methods, such as stamping, forging, or machining. In embodiments where portions of the club head 100 having thin regions are manufactured using stamping, forging, or machining, the portions of the club head 100 can be coupled using epoxy, tape, welding, mechanical fasteners, or other suitable methods.

xv. Optimized Materials

In some embodiments, the golf club head 100, comprising the heel to toe crown and sole curvatures described above, can further include optimized materials as described below. The strikeface 104 of the club head 100 comprises a first material. In many embodiments, the first material is a metal alloy, such as a titanium alloy, a steel alloy, an aluminum alloy, or any other metal or metal alloy. In other embodiments, the first material can comprise any other material, such as a composite, plastic, or any other suitable material or combination of materials. For example, the first material can comprise a combination of composite and metal materials.

The body 102 of the club head 100 comprises a second material. In many embodiments, the second material is a metal alloy, such as a titanium alloy, a steel alloy, an aluminum alloy, or any other metal or metal alloy. In other embodiments, the second material can comprise any other material, such as a composite, plastic, or any other suitable material or combination of materials. In some embodiments, a portion of the body comprises a different material than the rest of the body. For example, the body can comprise a composite material that makes up a portion or the entirety of the crown, skirt, and/or sole, and a metallic material for the rest of the body.

The first and second material each comprise a strength-to-weight ratio, or specific strength, measured as the ratio of the yield stress ($\sigma_y$) to the density ($\rho$) of the material (see Relation 1 below), and a strength-to-modulus ratio or specific flexibility measured as the ratio of the yield stress ($\sigma_y$) to the elastic modulus (E) of the material (see Relation 2 below).

$$\text{Specific Strength} = \frac{\sigma_y}{\rho} \qquad \text{Relation 1}$$

$$\text{Specific Flexibility} = \frac{\sigma_y}{E} \qquad \text{Relation 2}$$

In some embodiments, the strikeface 104 and/or the body 102 can comprise an optimized material having increased specific strength and/or increased specific flexibility. The specific flexibility is measured as a ratio of the yield strength to the elastic modulus of the optimized material. Increasing specific strength and/or specific flexibility can allow portions of the club head to be thinned, while maintaining durability.

In some embodiments, the first material of the strikeface 104 can be an optimized material, as described in U.S. Provisional Patent Appl. No. 62/399,929, entitled "Golf Club Heads with Optimized Material Properties." In these or other embodiments, the first material comprising an optimized titanium alloy can have a specific strength greater than or equal to approximately 900,000 PSI/lb/in$^3$ (224 MPa/g/cm$^3$), greater than or equal to approximately 910,000 PSI/lb/in$^3$ (227 MPa/g/cm$^3$), greater than or equal to approximately 920,000 PSI/lb/in$^3$ (229 MPa/g/cm$^3$), greater than or equal to approximately 930,000 PSI/lb/in$^3$ (232 MPa/g/cm$^3$), greater than or equal to approximately 940,000 PSI/lb/in$^3$ (234 MPa/g/cm$^3$), greater than or equal to approximately 950,000 PSI/lb/in$^3$ (237 MPa/g/cm$^3$), greater than or equal to approximately 960,000 PSI/lb/in$^3$ (239 MPa/g/cm$^3$), greater than or equal to approximately 970,000 PSI/lb/in$^3$ (242 MPa/g/cm$^3$), greater than or equal to approximately 980,000 PSI/lb/in$^3$ (244 MPa/g/cm$^3$), greater than or equal to approximately 990,000 PSI/lb/in$^3$ (247 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), or greater than or equal to approximately 1,150,000 PSI/lb/in$^3$ (286 MPa/g/cm$^3$).

Further, in these or other embodiments, the first material comprising an optimized titanium alloy can have a specific flexibility greater than or equal to approximately 0.0075, greater than or equal to approximately 0.0080, greater than or equal to approximately 0.0085, greater than or equal to approximately 0.0090, greater than or equal to approximately 0.0091, greater than or equal to approximately 0.0092, greater than or equal to approximately 0.0093, greater than or equal to approximately 0.0094, greater than or equal to approximately 0.0095, greater than or equal to approximately 0.0096, greater than or equal to approximately 0.0097, greater than or equal to approximately 0.0098, greater than or equal to approximately 0.0099, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the first material comprising an optimized steel alloy can have a specific strength greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 810,000 PSI/lb/in$^3$ (202 MPa/g/cm$^3$), greater than or equal to approximately 820,000 PSI/lb/in$^3$ (204 MPa/g/cm$^3$), greater than or equal to approximately 830,000 PSI/lb/in$^3$ (207 MPa/g/cm$^3$), greater than or equal to approximately 840,000 PSI/lb/in$^3$ (209 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), greater than or equal to approximately 1,100,000 PSI/lb/in$^3$ (274 MPa/g/cm$^3$), greater than or equal to approximately 1,115,000 PSI/lb/in$^3$ (278 MPa/g/cm$^3$), or greater than or equal to approximately 1,120,000 PSI/lb/in$^3$ (279 MPa/g/cm$^3$).

Further, in these or other embodiments, the first material comprising an optimized steel alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized first material allow the strikeface 104, or portions thereof, to be thinned, as described above, while maintaining durability. Thinning of the strikeface 104 can reduce the weight of the strikeface, thereby increasing discretionary weight to be strategically positioned in other areas of the club head 100 to position the head CG low and back and/or increase the club head moment of inertia.

In some embodiments, the second material of the body 102 can be an optimized material, as described in U.S. Provisional Patent Appl. No. 62/399,929, entitled "Golf Club Heads with Optimized Material Properties." In these or other embodiments, the second material comprising an optimized titanium alloy can have a specific strength greater than or equal to approximately 730,500 PSI/lb/in$^3$ (182 MPa/g/cm$^3$). For example, the specific strength of the optimized titanium alloy can be greater than or equal to approximately 650,000 PSI/lb/in$^3$ (162 MPa/g/cm$^3$), greater than or equal to approximately 700,000 PSI/lb/in$^3$ (174 MPa/g/cm$^3$), greater than or equal to approximately 750,000 PSI/lb/in$^3$ (187 MPa/g/cm$^3$), greater than or equal to approximately 800,000 PSI/lb/in$^3$ (199 MPa/g/cm$^3$), greater than or equal to approximately 850,000 PSI/lb/in$^3$ (212 MPa/g/cm$^3$), greater than or equal to approximately 900,000 PSI/lb/in$^3$ (224 MPa/g/cm$^3$), greater than or equal to approximately 950,000 PSI/lb/in$^3$ (237 MPa/g/cm$^3$), greater than or equal to approximately 1,000,000 PSI/lb/in$^3$ (249 MPa/g/cm$^3$), greater than or equal to approximately 1,050,000 PSI/lb/in$^3$ (262 MPa/g/cm$^3$), or greater than or equal to approximately 1,100,000 PSI/lb/in$^3$ (272 MPa/g/cm$^3$).

Further, in these or other embodiments, the second material comprising an optimized titanium alloy can have a specific flexibility greater than or equal to approximately 0.0060, greater than or equal to approximately 0.0065, greater than or equal to approximately 0.0070, greater than or equal to approximately 0.0075, greater than or equal to approximately 0.0080, greater than or equal to approximately 0.0085, greater than or equal to approximately 0.0090, greater than or equal to approximately 0.0095, greater than or equal to approximately 0.0100, greater than or equal to approximately 0.0105, greater than or equal to approximately 0.0110, greater than or equal to approximately 0.0115, or greater than or equal to approximately 0.0120.

In these or other embodiments, the second material comprising an optimized steel can have a specific strength greater than or equal to approximately 500,000 PSI/lb/in$^3$ (125 MPa/g/cm$^3$), greater than or equal to approximately 510,000 PSI/lb/in$^3$ (127 MPa/g/cm$^3$), greater than or equal to approximately 520,000 PSI/lb/in$^3$ (130 MPa/g/cm$^3$), greater than or equal to approximately 530,000 PSI/lb/in$^3$ (132 MPa/g/cm$^3$), greater than or equal to approximately 540,000 PSI/lb/in$^3$ (135 MPa/g/cm$^3$), greater than or equal to approximately 550,000 PSI/lb/in$^3$ (137 MPa/g/cm$^3$), greater than or equal to approximately 560,000 PSI/lb/in$^3$ (139 MPa/g/cm$^3$), greater than or equal to approximately 570,000 PSI/lb/in$^3$ (142 MPa/g/cm$^3$), greater than or equal to approximately 580,000 PSI/lb/in$^3$ (144 MPa/g/cm$^3$), greater than or equal to approximately 590,000 PSI/lb/in$^3$ (147 MPa/g/cm$^3$), greater than or equal to approximately 600,000 PSI/lb/in$^3$ (149 MPa/g/cm$^3$), greater than or equal to approximately 625,000 PSI/lb/in$^3$ (156 MPa/g/cm$^3$), greater than or equal to approximately 675,000 PSI/lb/in$^3$ (168 MPa/g/cm$^3$), greater than or equal to approximately 725,000 PSI/lb/in$^3$ (181 MPa/g/cm$^3$), greater than or equal to approximately 775,000 PSI/lb/in$^3$ (193 MPa/g/cm$^3$), greater than or equal to approximately 825,000 PSI/lb/in$^3$ (205 MPa/g/cm$^3$), greater than or equal to approximately 875,000 PSI/lb/in$^3$ (218 MPa/g/cm$^3$), greater than or equal to approximately 925,000 PSI/lb/in$^3$ (230 MPa/g/cm$^3$), greater than or equal to approximately 975,000 PSI/lb/in$^3$ (243 MPa/g/cm$^3$), greater than or equal to approximately 1,025,000 PSI/lb/in$^3$ (255 MPa/g/cm$^3$), greater than or equal to approximately 1,075,000 PSI/lb/in$^3$ (268 MPa/g/cm$^3$), or greater than or equal to approximately 1,125,000 PSI/lb/in$^3$ (280 MPa/g/cm$^3$).

Further, in these or other embodiments, the second material comprising an optimized steel can have a specific flexibility greater than or equal to approximately 0.0060, greater than or equal to approximately 0.0062, greater than or equal to approximately 0.0064, greater than or equal to approximately 0.0066, greater than or equal to approximately 0.0068, greater than or equal to approximately 0.0070, greater than or equal to approximately 0.0072, greater than or equal to approximately 0.0076, greater than or equal to approximately 0.0080, greater than or equal to approximately 0.0084, greater than or equal to approximately 0.0088, greater than or equal to approximately 0.0092, greater than or equal to approximately 0.0096, greater than or equal to approximately 0.0100, greater than or equal to approximately 0.0105, greater than or equal to approximately 0.0110, greater than or equal to approximately 0.0115, greater than or equal to approximately 0.0120, greater than or equal to approximately 0.0125, greater than or equal to approximately 0.0130, greater than or equal to approximately 0.0135, greater than or equal to approximately 0.0140, greater than or equal to approximately 0.0145, or greater than or equal to approximately 0.0150.

In these embodiments, the increased specific strength and/or increased specific flexibility of the optimized second material allow the body 102, or portions thereof, to be thinned, while maintaining durability. Thinning of the body can reduce club head weight, thereby increasing discretionary weight to be strategically positioned in other areas of the club head 100 to position the head CG low and back and/or increase the club head moment of inertia.

xvi. Movable Weight

In some embodiments, the golf club head 100, comprising the heel to toe crown and sole curvatures described above, can further include a movable weight system as described below. In some embodiments, the club head 100 can include one or more weight structures 380 comprising one or more removable weights 382, the golf club head 100 as described above further comprises a single slot 240 in the rear portion of the sole 118, wherein the single slot 240 is the receiving geometry for the weight assembly 380. The golf club head 100 does not comprise a plurality of slots.

Figure 1B:
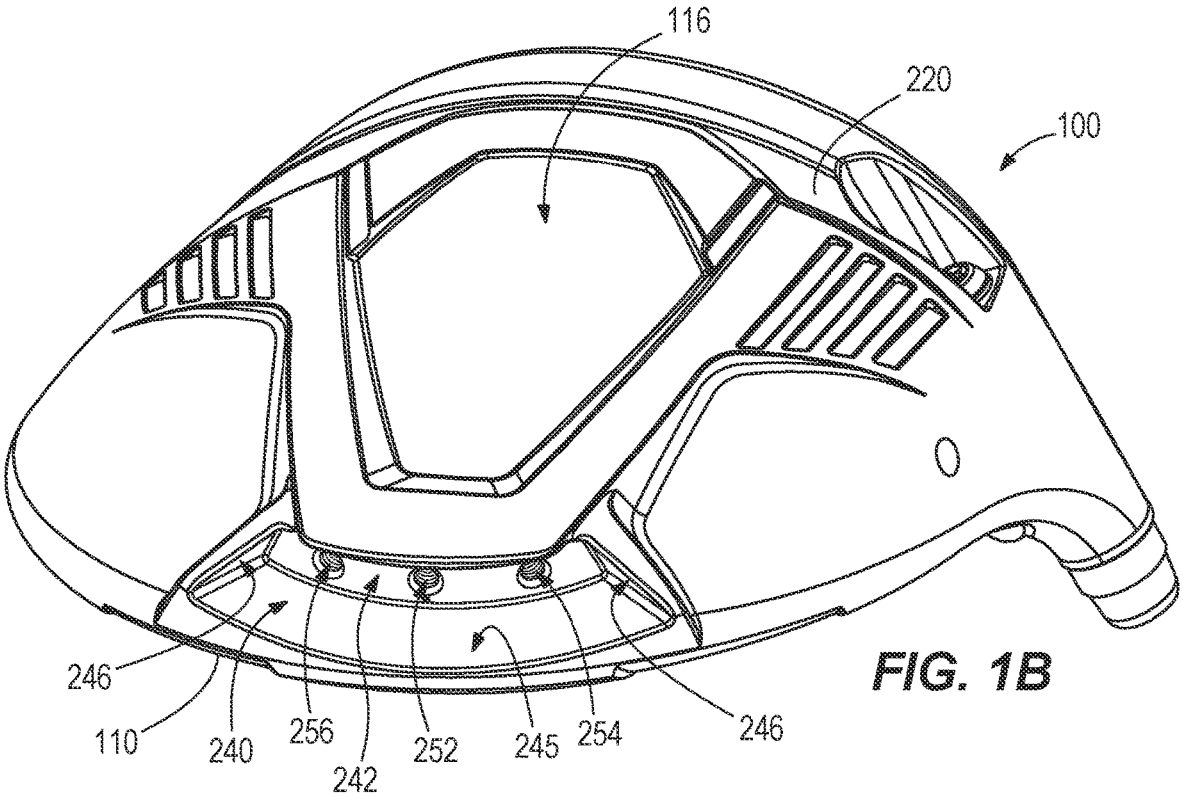
FIG. 1B is a rear perspective view of the golf club head in FIG. 1.

Referring to FIGS. 1A and 1B, the slot 240 in the sole 118 of the golf club head 100 comprises a slot interior surface 242, wherein the slot interior surface 242 is approximately perpendicular to the sole 118. The slot interior surface 242 comprises a slot length 257. The slot 240 comprises a slot bottom surface 244 that is perpendicular to the slot interior surface 242 and approximately parallel to the sole 118. The slot 240 comprises a top surface 245 that is perpendicular to the slot interior surface 242 and approximately parallel to the sole 116. The slot 240 bottom surface 244 does not extend as far towards the rear of the golf club head 100 as the slot top surface 245. The slot 240 further comprises two sidewalls 246. The two slot sidewalls 246 are at toeward and heelward ends of the slot interior surface 242. The slot interior surface 242, bottom surface 244, top surface 245, and two sidewalls 246 define a channel 248 open to the rear and bottom of the golf club head 100 such that when the slot 240 receives the weight assembly 380, at least a portion of the outer 362 and lower surfaces 369 of the weight assembly 380 are both exposed. The outer 362 and lower surfaces 369 of the weight assembly 380 are not concealed or entirely surrounded by the slot bottom surface 244.

The slot 240 may comprise two to six apertures. The slot 240 may comprise 2, 3, 4, 5, or 6 apertures. In most embodiments, the apertures are equally spaced, however in some embodiments, the apertures can be unevenly spaced across the interior surface 242 of the slot 240. In the exemplary embodiment, the slot 240 comprises three apertures spaced along the interior surface of the slot 242 such that each aperture center is spaced between 0.5 inch and 0.6 inch from the adjacent aperture(s).

The weight assembly 380 can be positioned and affixed within the single slot 240. The position of the weight assembly 380 within the single slot 240 determines the effect that the mass of the weight assembly 380 will have on the position of the total CG 180 of the golf club head 100. A movement of the weight assembly 380 toward the toe 122 or heel 120 of the golf club head 100 will move the CG 180, and will help shape the flight of a golf ball when it is struck with the golf club head 100.

The single slot 240 can further comprise at least a central aperture 252, a heel-side aperture 254, and a toe-side aperture 256. Each of the apertures comprise weight assembly 380 attachment points within the single slot 240. Each of the toe-side, central, and heel-side apertures comprise a circular cross section and an aperture center. Each of the toe-side, central, and heel-side apertures are threaded to receive a threaded fastener 390.

The golf club head 100 can further comprise a shroud 220, wherein the shroud 220 is a portion of the sole 116 of the golf club head 100 that can extend to span over the slot 240. The shroud 220 may comprise a portion or all of the bottom surface 244.

In most embodiments, the shape of the interior surface of the slot 242 is complimentary to the shape of the inner surface 364 of the weight member 370. In the exemplary embodiment, the interior surface of the slot 242 is convex and is complementary to the concave interior surface 364 of the weight member 370.

The slot length 257 of the slot interior surface 242 may vary between 1.6 inches and 2.0 inches. The slot length 257 may be 1.6 inches, 1.7 inches, 1.8 inches, 1.9 inches, or 2.0 inches. The slot length 257 of the slot interior surface 242 is no longer than 2.0 inches.

Further, in some embodiments, the slot 240 can comprise an asymmetric shape, wherein the cross-sectional shape of the slot 240 in a heel to toe direction is non-uniform. The shape of the slot 240 is imperative to the security of the weight assembly within the slot 240, since the asymmetric cross-sectional shape of the slot channel 248 enables three positions to align the weight assembly 380 with one of the heel-side 254, toe-side 256, or central 252 apertures. Due to the asymmetric shape of the slot 240 the weight assembly 380 is unable to slide throughout the channel 248. Rather, the weight assembly 380 must be removed and placed in one of the three distinct positions.

Furthermore, the slot 240 can comprise a height 247 measured from the bottom surface of the slot 244 to the sole 116. Wherein the height 247 of the slot 240 is the height of the channel 248. In most embodiments, the slot 240 can comprise a variable height 247, wherein the height is inconsistent in the heel to toe direction. The non-uniform height of the slot 240 is imperative to the security of the weight assembly 380 within the slot 240, since the variable height 247 of the channel 248 enables three positions to align the weight assembly 380 with one of the heel-side 254, toe-side 256, or central 252 apertures. Due to the non-uniform height 247 of the slot 240 the weight assembly 380 is unable to slide laterally throughout the channel 248. Rather, the weight assembly 380 must be removed and placed in one of the three distinct positions. This prevents the golfer from being provided unlimited position choices that create confusion in determining shot shape of the golf ball and flight.

The variable height 247 of the slot 240 may vary in a range between 0.2 and 0.6 inch. The variable height 247 of the slot 240 may be 0.2 inch, 0.3 inch, 0.4 inch, 0.5 inch, or 0.6 inch.

In some embodiments, the golf club head 100 can comprise a shroud 220, wherein a portion of the sole 118 of the golf club head can span over the slot 240. The shroud 220 functions to increase the aerodynamics of the channel 248 and assist in properly inserting the weight member 370 within the slot 240. The shroud 220 can have any desired geometry to cover a specific portion(s) of the slot or the entire slot 240. In some embodiments, the shroud 220 can cover 5%-10% of the slot, 10%-15% of the slot, 15%-20% of the slot, 20%-25% of the slot, 25%-30% of the slot, 30%-35% of the slot, 35%-40% of the slot, 40%-45% of the slot, 45%-50% of the slot, 50%-55% of the slot, 55%-60% of the slot, 60%-65% of the slot, 65%-70% of the slot, 70%-75% of the slot, 75%-80% of the slot, 80%-85% of the slot, 85%-90% of the slot, 90%-95% of the slot, or 95%-100% of the slot.

The slot 240 and the weight assembly 380 enable a large amount of mass (preferably over 25 grams) to be placed as far away from the strike face as possible, which drastically increases the MOI of the golf club head, with further deepening the CG depth of the golf club head. Further, the increased MOI and CG depth, prevent the strikeface 104 from rotating on off center impacts, leading to a more forgiving golf club head.

xvii. Example 1: Comparison Between Club Head Described Herein and Control Club Head Without Curvature (Computer Simulation)

Described herein is an exemplary golf club head having similar dimensions (length, width, height, depth) as golf club head 100. The exemplary club head comprises a heel to toe crown radius of curvature 156 of 4.0 inches, and a heel to toe sole radius of curvature 158 of 6.0. The exemplary club head includes a volume of 466 cc, a plurality of thin regions (similar to that of golf club head 100) on the crown comprising 57% of the surface area of the crown and having a minimum thickness of 0.013 inch. The exemplary club head further includes a crown angle (similar to that of golf club head 100) of 68.6 degrees and a crown height of 0.522 inch. The exemplary club head comprises a hosel height of 1.84 inches. The exemplary club head includes a weight structure with a 35 gram tungsten weight located in a central position of the weight structure.

The exemplary club head was compared to a control club head, wherein the control club head comprised the exact same weight structure, surface area of the crown, thickness of the crown, crown angle, club head volume, and club head mass. However, the control club head comprises a heel to toe crown radius of curvature 156 of 6.1 inches, and a heel to toe sole radius of curvature 158 of 4.0 inches. Due to the shallower heel to toe crown radius of curvature 156, in comparison to the exemplary club head, the control club head only has 32 gram tungsten weight located in the weight structure.

In reference to Table 1 below, the exemplary club head comprises a CG height that is 18.87% lower than the control club head, a CG depth that is 0.5% deeper than the control club head, while maintaining an extremely high MOI that is within 1.5% for the Ixx and Iyy. The 18.87% improvement of the CG height led to a 0.25 mph increase in ball speed, a reduction in spin of 350 rpm, and an increase in launch angle of 0.25 degrees. These improvements, due to the lower CG height, lead to an increase ball flight distance of 5-7 yards.

TABLE 1

| | Center of Gravity (in.) | | | | | |
|---|---|---|---|---|---|---|
| | X | Y | Z | Moment of Inertia (g*in.$^2$) | | |
| | +Heel/−Toe | +Crown/−Sole | +Front/−Back | $I_{xx}$ | $I_{yy}$ | $I_{zz}$ |
| Control Club | −0.023 | 0.824 | −2.096 | 688.47 | 898.61 | 433.26 |
| Exemplary Club Head | −0.062 | 0.669 | −2.106 | 679.64 | 890.74 | 399.76 |
| Change | −0.039 | −0.188 | −0.010 | −1.3% | −0.88% | −7.73% |

xviii. Example 2: Comparison Between Club Head Described Herein and Control Club Head Without Curvature (Pingman)

Described herein is an exemplary golf club head having similar dimensions (length, width, height, depth) as golf club head 100. The exemplary club head comprises a similar volume, mass, and crown thickness as the club head 100. Further, the exemplary club head comprises a heel to toe crown radius of curvature 156 of 4.0 inches, and a heel to toe sole radius of curvature 158 of 6.0. The exemplary club head comprises a hosel height of 1.84 inches. The exemplary club head includes a weight structure with a 35 gram tungsten weight located in a central position of the weight structure.

The exemplary club head was compared to a control club head, wherein the control club head comprised the same or similar weight structure, surface area of the crown, thickness of the crown, crown angle, club head volume, club head mass, loft angle, lie angle, and characteristic time. However, the control club head comprises a heel to toe crown radius of curvature 156 of 6.1 inches, and a heel to toe sole radius of curvature 158 of 4.0 inches. Due to the shallower heel to toe crown radius of curvature 156, in comparison to the exemplary club head, the control club head only has 32 gram tungsten weight located in the weight structure.

Each of the control club and the exemplary club were hit 45 times. In reference to Table 2 below, the exemplary club head comprises a CG height that is 15.45% lower than the control club head, a CG depth that is 2.95% deeper than the control club head, while maintaining a high MOI that is similar to that of the control club head. The improvements of the CG height and depth led to a 400 rpm reduction in backspin, and a 1 degree increase in launch angle. These improvements lead to an increase in ball flight distance. The stat area is likely to be unchanged because the MOI is similar.

TABLE 2

| Mass Properties - Player Test Clubheads | | | | | | | | | | |
|---|---|---|---|---|---|---|---|---|---|---|
| | X CG (in.) (−Toe/+Heel) | | Y CG (in.) (−Sole/+Crown) | | Z CG (in.) (−Rear/+Face) | | $I_{xx}$ (g*in$^2$) | | $I_{yy}$ (g*in$^2$) | |
| | CAD | Prototype | CAD | Prototype | CAD | Prototype | CAD | Prototype | CAD | Prototype |
| Control Club Head | −0.027 | −0.007 | 0.849 | 0.861 | −1.979 | −1.969 | 662.2 | 652.2 | 876.5 | 867.5 |
| Exemplary Club Head | −0.008 | 0.018 | 0.0701 | 0.728 | −1.931 | −1.911 | 631.2 | 635.2 | 868.3 | 856.1 |
| Change | 0.019 | 0.025 | −0.148 | −0.133 | 0.048 | 0.058 | −4.7% | −2.6% | −0.9% | −1.3% |

The invention claimed is:

1. A golf club head comprising:

a body having a front end, a back end opposite the front end, a crown, a sole opposite the crown, a heel, a toe opposite the heel, a skirt adjoining the crown and the sole, and a hosel structure having a hosel axis extending centrally through a bore in the hosel structure;

the hosel structure further comprises a hosel height measured in a direction from a hosel end to the sole, in a direction parallel to the hosel axis; wherein the hosel height is between 1.75 inch and 1.85 inch;

a strikeface positioned at the front end and defining a geometric center of the strikeface;

wherein a strikeface perimeter is located along an outer edge of the strikeface where a strikeface curvature deviates from a strikeface bulge and/or a strikeface roll radius of curvature, a loft plane tangent to the geometric center of the strikeface, and a head depth plane extending through the geometric center of the strikeface from the heel to the toe, perpendicular to the loft plane;

wherein the geometric center of the strikeface defines a coordinate system having an origin located at the geometric center of the strikeface; the coordinate system having an X' axis, a Y' axis, and a Z' axis; wherein the X' axis extends through the geometric center of the strikeface in a direction from the heel to the toe of the golf club head; wherein the Y' axis extends through the geometric center of the strikeface in a direction from the crown to the sole of the golf club head and perpendicular to the X' axis; and wherein the Z' axis extends through the geometric center of the strikeface in a direction from the front end to the back end of the golf club head, and perpendicular to the X' axis and the Y' axis;

wherein an X'Y' plane extends through the X' axis and the Y' axis, an X'Z' plane extends through the X' axis and the Z' axis, and a Y'Z' plane extends through the Y' axis and the Z' axis;

wherein the X'Y' plane, the X'Z' plane, and the Y'Z' plane are all perpendicular to one another and intersect at the geometric center of the strikeface;

wherein:

a loft angle of the golf club head is less than 16 degrees;

a volume of the golf club head is greater than 425 cc;

a crown transition region, positioned between the strikeface and the crown, including a crown heel to toe radius of curvature extending along an entire top edge of the strikeface from near the heel to the toe of the golf club head;

wherein the crown heel to toe radius of curvature is in a range of 3.0 to 3.5 inches;

a sole transition region, positioned between the strikeface and the sole, the sole transition region including a sole heel to toe radius curvature extending along an entire bottom edge of the strikeface from near the heel to the toe of the golf club head;

wherein an entirety of the sole heel to toe radius is in a range of 6.25 to 7.75 inches;

further comprising a plurality of turbulators positioned upon the crown; and the crown comprises one or more thin regions each having a thickness, measured from an outer surface of the crown to an inner surface of the crown, of 0.017 to 0.020 inch, wherein the thickness of each thin region decreases in a direction from the strikeface towards the back end.

2. The golf club head of claim 1, further comprising:

a front radius of curvature between 0.18 to 0.30 inch, wherein the front radius of curvature extends from a top edge of the strikeface to a crown transition point, the crown transition point indicating a change in curvature from the front radius of curvature to a different curvature of the crown; and a rear radius of curvature between 0.12 inch and 0.25 inch that extends between the crown and the skirt of the golf club head along a rear transition boundary from a first rear transition point located at a junction between the crown and the rear transition boundary and a second rear transition point located at the junction between the rear transition boundary and the skirt of the golf club head.

3. The golf club head of claim 1, wherein the plurality of turbulators project from an outer surface of the crown adjacent to a crown transition point between the strikeface and a crown apex;

wherein each adjacent pair of turbulators is separate and spaced apart to define a space between the adjacent pair of turbulators, and wherein each turbulator extends between the heel and the toe to define a turbulator width and extends between the strikeface and the back end to define a turbulator length;

wherein the turbulator length is substantially greater than the turbulator width;

wherein at least a portion of at least one turbulator is located between the strikeface and the crown apex; and wherein a spacing between adjacent turbulators is greater than a turbulator width of each of the adjacent turbulators.

4. The golf club head of claim 1, wherein the hosel structure comprises an outer diameter; wherein the outer diameter is less than 0.545 inch.

5. The golf club head of claim 2, further comprising a crown angle, measured between a crown axis and the Y'Z' plane, less than 70 degrees.

6. The golf club head of claim 5, further comprising:

a front radius of curvature measured in a strikeface to rear direction extending from the front end of the golf club head where a contour departs from a roll radius or a bulge radius of the strikeface to a crown transition point indicating a change in curvature from the front radius of curvature to a curvature of the crown; and a rear radius of curvature measured in a strikeface to rear direction extending from the crown to a skirt of the golf club head wherein the rear radius of curvature comprises a single radius of curvature that transitions the crown to the skirt along a rear transition boundary;

wherein the front radius of curvature is in a range of 0.25 inch to 0.50 inch; and wherein the rear radius of curvature is in a range of 0.10 inch to 0.30 inch.

7. The golf club head of claim 5, further comprising:

the crown axis extending between the crown transition point and a rear transition point; and a crown height measured as the greatest distance between the crown and the crown axis;

wherein the crown height is in a range of 0.40 inch to 0.60 inch.

* * * * *